US009759216B2

(12) United States Patent
Kato

(10) Patent No.: US 9,759,216 B2
(45) Date of Patent: Sep. 12, 2017

(54) SCROLL COMPRESSOR

(71) Applicant: DAIKIN INDUSTRIES, LTD., Osaka-shi, Osaka (JP)

(72) Inventor: Katsumi Kato, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 122 days.

(21) Appl. No.: 14/431,712

(22) PCT Filed: Sep. 27, 2013

(86) PCT No.: PCT/JP2013/076354
§ 371 (c)(1),
(2) Date: Mar. 26, 2015

(87) PCT Pub. No.: WO2014/051085
PCT Pub. Date: Apr. 3, 2014

(65) Prior Publication Data

US 2015/0260189 A1 Sep. 17, 2015

(30) Foreign Application Priority Data

Sep. 27, 2012 (JP) ..... 2012-215068

(51) Int. Cl.
*F04C 18/02* (2006.01)
*F04C 23/00* (2006.01)
(Continued)

(52) U.S. Cl.
CPC ..... *F04C 29/028* (2013.01); *F01C 17/066* (2013.01); *F01C 21/10* (2013.01);
(Continued)

(58) Field of Classification Search
CPC .. F04C 18/0215; F04C 23/008; F04C 29/028; F04C 29/023; F04C 29/02; F04C 29/026;
(Continued)

(56) References Cited

U.S. PATENT DOCUMENTS

| | | | | |
|---|---|---|---|---|
| 6,533,561 | B1 | 3/2003 | Furusho et al. | |
| 2010/0092321 | A1 | 4/2010 | Kim et al. | |
| 2012/0177521 | A1* | 7/2012 | Oka | F04C 18/0215 418/55.1 |

FOREIGN PATENT DOCUMENTS

| | | | |
|---|---|---|---|
| EP | 2 479 435 | A1 | 7/2012 |
| JP | 2001-214872 | A | 8/2001 |
| JP | 2012-67712 | A | 4/2012 |

OTHER PUBLICATIONS

European Search Report of corresponding EP Applicaton No. 13 84 0750.7 dated Apr. 13, 2016.

(Continued)

*Primary Examiner* — Mark Laurenzi
*Assistant Examiner* — Wesley Harris
(74) *Attorney, Agent, or Firm* — Global IP Counselors, LLP

(57) ABSTRACT

A scroll compressor includes fixed and movable scrolls, and a drive part. The fixed scroll has a fixed-side end plate, a fixed-side lap, and a thrust sliding portion surrounding the first lap. The movable scroll has a movable-side end plate and a movable-side lap. The drive part revolves the movable scroll so that refrigerant in a compression chamber formed by the fixed-side lap and movable-side lap is compressed. A back-pressure space which communicates with the compression chamber for at least a prescribed period in a revolution cycle is formed at the back face side of the movable scroll. A first oil channel supplied with oil from a space is formed in a first angle region of the fixed-side end plate. A communication channel formed in a second angle region communicates with the compression chamber. A second oil channel communicating with the back-pressure space is formed in the second angle region.

18 Claims, 9 Drawing Sheets

(51) Int. Cl.

| | |
|---|---|
| ***F04C 29/02*** | (2006.01) |
| ***F01C 21/10*** | (2006.01) |
| ***F01C 17/06*** | (2006.01) |
| ***F25B 31/00*** | (2006.01) |

(52) U.S. Cl.
CPC ..... *F04C 18/0215* (2013.01); *F04C 18/0253* (2013.01); *F04C 29/02* (2013.01); *F04C 29/023* (2013.01); *F04C 29/026* (2013.01); *F25B 31/004* (2013.01); *F04C 23/008* (2013.01)

(58) Field of Classification Search
CPC .... F04C 18/0253; F01C 21/10; F01C 17/066; F25B 31/004
USPC ..... 418/55.6, 55.1, 94, 55.2
See application file for complete search history.

(56) References Cited

OTHER PUBLICATIONS

International Preliminary Report of corresponding PCT Application No. PCT/JP2013/076354 dated Apr. 9, 2015.
International Search Report of corresponding PCT Application No. PCT/JP2013/076354 dated Dec. 24, 2013.

* cited by examiner

SCROLL COMPRESSOR

CROSS-REFERENCE TO RELATED APPLICATIONS

This U.S. National stage application claims priority under 35 U.S.C. §119(a) to Japanese Patent Application No. 2012-215068, filed in Japan on Sep. 27, 2012, the entire contents of which are hereby incorporated herein by reference.

TECHNICAL FIELD

The present invention relates to a scroll compressor in which a back-pressure space of a movable scroll communicates with a peripheral compression chamber.

BACKGROUND ART

With regard to scroll compressors, there are cases when an oil channel to which oil is supplied from a high-pressure space is formed in a thrust sliding portion of a fixed scroll in order to lubricate a portion where contact is made between the thrust sliding portion of the fixed scroll and an end plate of a movable scroll, as shown in Japanese Unexamined Patent Application 2001-214872. In particular, in Japanese Unexamined Patent Application 2001-214872, an oil channel is formed across the entire circumference of the fixed scroll, therefore oil is supplied to the entire portion where contact is made between the thrust sliding portion and the end plate of the movable scroll and a desirable lubrication state is ensured.

As described in Japanese Unexamined Patent Application 2012-67712, there are cases when a back-pressure space which is at an intermediate pressure (a pressure intermediate between an intake pressure and a discharge pressure) and communicates with a peripheral compression chamber is formed on the back side of the movable scroll in certain scroll compressors.

When such a back-pressure space is provided, there are cases when a communication channel, which can communicates at a desired timing with a communication hole formed in the movable scroll, is formed in the thrust sliding portion of the fixed scroll and the back-pressure space is communicated with the compression chamber which is at a desired intermediate pressure so that the pressure of the back-pressure space becomes a desired intermediate pressure.

SUMMARY OF THE INVENTION

Technical Problem

However, when the communication channel that communicates with the peripheral compression chamber is formed in the thrust sliding portion of the fixed scroll as described above, it becomes difficult for the oil channel to which oil is supplied from the high-pressure space being formed across the entire circumference of the fixed scroll as described in Japanese Unexamined Patent Application 2001-214872. The inventors of the present application discovered that there are cases in which oil is not supplied adequately in the vicinity of the communication channel of the thrust sliding portion where the oil channel is not formed.

It is an object of the present invention to provide a highly reliable scroll compressor in which, oil is supplied to the entirety of the portion where sliding occurs between a fixed scroll and a movable scroll even when a back-pressure space is formed at the back side and at the external circumference of the movable scroll and a communication channel for allowing communication between a peripheral compression chamber and the back-pressure space is formed in the fixed scroll.

Solution to Problem

A scroll compressor according to a first aspect of the present invention is provided with a fixed scroll, a movable scroll, and a drive part. The fixed scroll has a tabular first end plate, a spiraling first lap protruding from a front face of the first end plate, and a thrust sliding portion surrounding the first lap. The movable scroll has a tabular second end plate and a spiraling second lap protruding from a front face of the second end plate. The drive part is linked to the movable scroll via a crankshaft and revolves the movable scroll. The first lap and second lap are brought together so that the front face of the first end plate and the front face of the second end plate face each other, and a compression chamber is formed between the first lap and the second lap adjacent to each other. The drive part revolves the movable scroll cyclically so that a gaseous refrigerant in the compression chamber is compressed. A back-pressure space that communicates with the compression chamber on a peripheral side for at least a prescribed period in a revolution cycle of the movable scroll is formed at a back face side of the second end plate of the movable scroll. A communication hole that communicates with the back-pressure space is formed in the second end plate. A first oil channel, a communication channel, and a second oil channel are formed on a sliding face contacting the front face of the second end plate for at least a prescribed period in the single revolution cycle of the movable scroll, in the thrust sliding portion facing the front face of the second end plate. The first oil channel extends in an arc shape in a first angle region with respect to a center of the first end plate as seen in plan view. Oil is supplied to the first oil channel from a high-pressure space that communicates with the compression chamber at high pressure and retained in the first oil channel. The communication channel is disposed in a second angle region, which is external to the first angle region, with respect to the center of the first end plate as seen in plan view. The communication channel communicates with the compression chamber, and communicates with the communication hole for at least a prescribed period. The second oil channel is disposed in the second angle region with respect to the center of the first end plate as seen in plan view and communicates with the back-pressure space for at least a prescribed period.

According to the aspect described above, a second oil channel that communicates with the back-pressure space for a prescribed period is formed in the vicinity of the communication channel of the thrust sliding portion where it is difficult to form the first oil channel (in the second angle region with respect to the center of the first end plate of the fixed scroll as seen in plan view).

In the first angle region, oil being supplied to the first oil channel is supplied to a portion where contact is made between the thrust sliding portion and the second end plate of the movable scroll. Since the first oil channel is not formed in the second angle region, oil being supplied to the first oil channel is not readily supplied to the second angle region. However, since the second oil channel that communicates with the back-pressure space is formed in the second angle region, oil being present in the back-pressure space is collected in the second oil channel and is supplied to the portion where contact is made between the thrust sliding portion and the second end plate in the second angle region.

Specifically, oil can be supplied to the entire portion where contact is made between the thrust sliding portion and the second end plate by the first oil channel and the second oil channel. As a result, the reliability of the scroll compressor can be enhanced.

A scroll compressor according to a second aspect of the present invention is provided with a fixed scroll, a movable scroll, and a drive part. The fixed scroll has a tabular first end plate, a spiraling first lap protruding from a first face of the first end plate, and a thrust sliding portion surrounding the first lap. The movable scroll has a tabular second end plate and a spiraling second lap protruding from the front face of the second end plate. The drive part is linked to the movable scroll via a crankshaft and revolves the movable scroll. The first lap and the second lap are brought together so that the front face of the first end plate and the front face of the second end plate face each other, and a compression chamber is formed between the first lap and the second lap adjacent to each other. The drive part revolves the movable scroll cyclically so that a gaseous refrigerant in the compression chamber is compressed. A back-pressure space that communicates with the compression chamber on a peripheral side for at least a prescribed period in a revolution cycle of the movable scroll is formed at a back face side of the second end plate of the movable scroll. A communication hole that communicates with the back-pressure space is formed in the second end plate. An oil introduction path, in which an oil supplied from a high-pressure space communicating with the compression chamber at high pressure flows, is formed in the fixed scroll. A first oil channel, a communication channel, and a second oil channel are formed on a sliding face contacting the front face of the second end plate for at least a prescribed period in the single revolution cycle of the movable scroll, in the thrust sliding portion facing the front face of the second end plate. The first oil channel extends in an arc shape in a first angle region with respect to a center of the first end plate as seen in plan view. Oil is supplied to the first oil channel from the oil introduction path and retained in the first oil channel. The communication channel is disposed in a second angle region, which is external to the first angle region, with respect to the center of the first end plate as seen in plan view. The communication channel communicates with the compression chamber, and communicates with the communication hole for at least a prescribed period. The second oil channel is disposed in the second angle region with respect to the center of the first end plate as seen in plan view and communicates with the back-pressure space for at least a prescribed period.

According to the aspect described above, oil can be supplied to the entire portion where contact is made between the thrust sliding portion and the second end plate via the first oil channel and the second oil channel. As a result, the reliability of the scroll compressor can be enhanced.

A scroll compressor according to a third aspect of the present invention is the scroll compressor according to the first aspect or second aspect, where the second oil channel extends radially a first distance and circumferentially a second distance with respect to the center of the first end plate as seen in plan view. The first distance is equal to or greater than the second distance.

According to the aspect described above, since the second oil channel extends further in the radial direction than in the circumferential direction as seen in plan view, the outer periphery of the movable scroll is not easily caught in the second oil channel when the movable scroll revolves. For this reason, oil can be supplied to the second angle region without adversely affecting the revolving movement of the movable scroll, and therefore a high-reliability scroll compressor can be obtained.

A scroll compressor according to a fourth aspect of the present invention is the scroll compressor according to the third aspect, in which the second oil channel is circular, ellipsoidal, rectangular, J-shaped, or L-shaped as seen in plan view.

According to the aspect described above, the second oil channel through which oil is supplied to the second angle region is formed by simple processing, and the reliability of the scroll compressor can be enhanced.

A scroll compressor according to a fifth aspect of the present invention is the scroll compressor according to any of the first through fourth aspects, wherein the communication channel extends radially with respect to the center of the first end plate as seen in plan view and is formed into a J-shape that curves inwardly with respect to the center of the first end plate. At least one of the second oil channels extends radially towards the center of the first end plate as seen in plan view and is formed into a J-shape that curves outwardly with respect to the center of the first end plate. A curved portion of the communication channel and a curved portion of the J-shaped second oil channel are disposed facing each other.

According to the aspect described above, since the J-shaped second oil channel is formed corresponding to the J-shaped communication channel in such a manner that the curved portions face one another, the second oil channel can be disposed close to the communication channel. In addition, the second oil channel can be disposed so that the curved portion of the second oil channel surrounds the curved portion of the communication channel. For this reason, oil can be adequately supplied through the second oil channel in the vicinity of the communication channel where it is difficult to retain oil due to the effect of the flow of refrigerant (the flow of refrigerant flowing from the compression chamber into the back-pressure space via the communication channel and the communication hole). As a result, the reliability of the scroll compressor can be enhanced.

A scroll compressor according to a sixth aspect of the present invention is the scroll compressor according to any of the first through fifth aspects, wherein at least part of the second oil channel is formed on a regular sliding face of the thrust sliding portion which always contacts with the front face of the second end plate.

According to the aspect described above, oil is supplied to the regular sliding face of the thrust sliding portion, which always contacts with the second end plate, via the second oil channel. There is a particular need for the regular sliding face to lubricate because the regular sliding face always contacts with the second end plate, and the reliability of the scroll compressor can be enhanced by adequately supplying oil to the regular sliding face.

A scroll compressor according to a seventh aspect of the present invention is the scroll compressor according to the sixth aspect, where the first oil channel and the communication channel are formed on the regular sliding face.

According to the aspect described above, the compression chamber on the peripheral side and back-pressure space are directly communicated only through the communication channel and the communication hole as the communication channel is formed on the regular sliding face, and therefore the pressure of the back-pressure space is controlled to an appropriate pressure. Meanwhile, oil cannot be supplied from the back-pressure space to the portion where contact is made between the thrust sliding portion and the second end plate through the communication channel. However, since at least part of the second oil channel which communicates with the back-pressure space is formed on the regular sliding face in the second angle region, it is possible to supply oil on the regular sliding face in the second angle region of the thrust sliding portion while implementing control on the pressure of the back-pressure space. In addition, because the first oil channel is formed on the regular sliding face in the first angle region, oil is readily supplied on the regular sliding face of the thrust sliding portion where lubrication is particularly required, and therefore a high-reliability scroll compressor can be obtained.

The scroll compressor according to an eighth aspect of the present invention is the scroll compressor of the first through seventh aspects, wherein the second oil channel always communicates with the back-pressure space.

Because the second oil channel always communicates with the back-pressure space, oil tends to be surely collected in the second oil channel, and therefore the oil is readily supplied to the second angle region from the second oil channel. As a result, the reliability of the scroll compressor can be enhanced.

A scroll compressor according to a ninth aspect of the present invention is the scroll compressor according to the first through eighth aspects, wherein the second oil channel includes a plurality of channels.

According to the aspect described above, since a plurality of second oil channels are present, oil is readily collected therein. Additionally, the second oil channels can be disposed at a selected area where oil is not readily supplied. For this reason, oil tends to be surely supplied from the second oil channel to the portion where contact is made between the thrust sliding portion of the second angle region and the second end plate. The reliability of the scroll compressor can be therefore enhanced.

Advantageous Effects of Invention

With the scroll compressor of the present invention, a second oil channel that communicates with a back-pressure space for a prescribed period is formed in the vicinity of the communication channel of a thrust sliding portion where it is difficult to form the first oil channel (in the second angle region with respect to the center of the first end plate of the fixed scroll as seen in plan view).

In the first angle region, oil being supplied to the first oil channel is supplied to the portion where contact is made between the thrust sliding portion and the second end plate of the movable scroll. Meanwhile, since the first oil channel is not formed in the second angle region, the oil being supplied to the first oil channel is not readily supplied to the second angle region. However, since the second oil channel that communicates with the back-pressure space is formed in the second angle region, oil being present in the back-pressure space is collected in the second oil channel and is supplied to the portion where contact is made between the thrust sliding portion of the second angle region and the second end plate.

Specifically, oil can be supplied to the entire portion where contact is made between the thrust sliding portion and the second end plate via the first oil channel and the second oil channel. The reliability of the scroll compressor can therefore be enhanced.

DESCRIPTION OF EMBODIMENTS

Embodiments

Embodiments of the scroll compressor of the present invention will now be described with reference to the accompanying drawings.

(1) Overall Configuration

The scroll compressor 10 according to this embodiment is used, for example, in the outdoor unit of an air conditioner.

Figure 1:
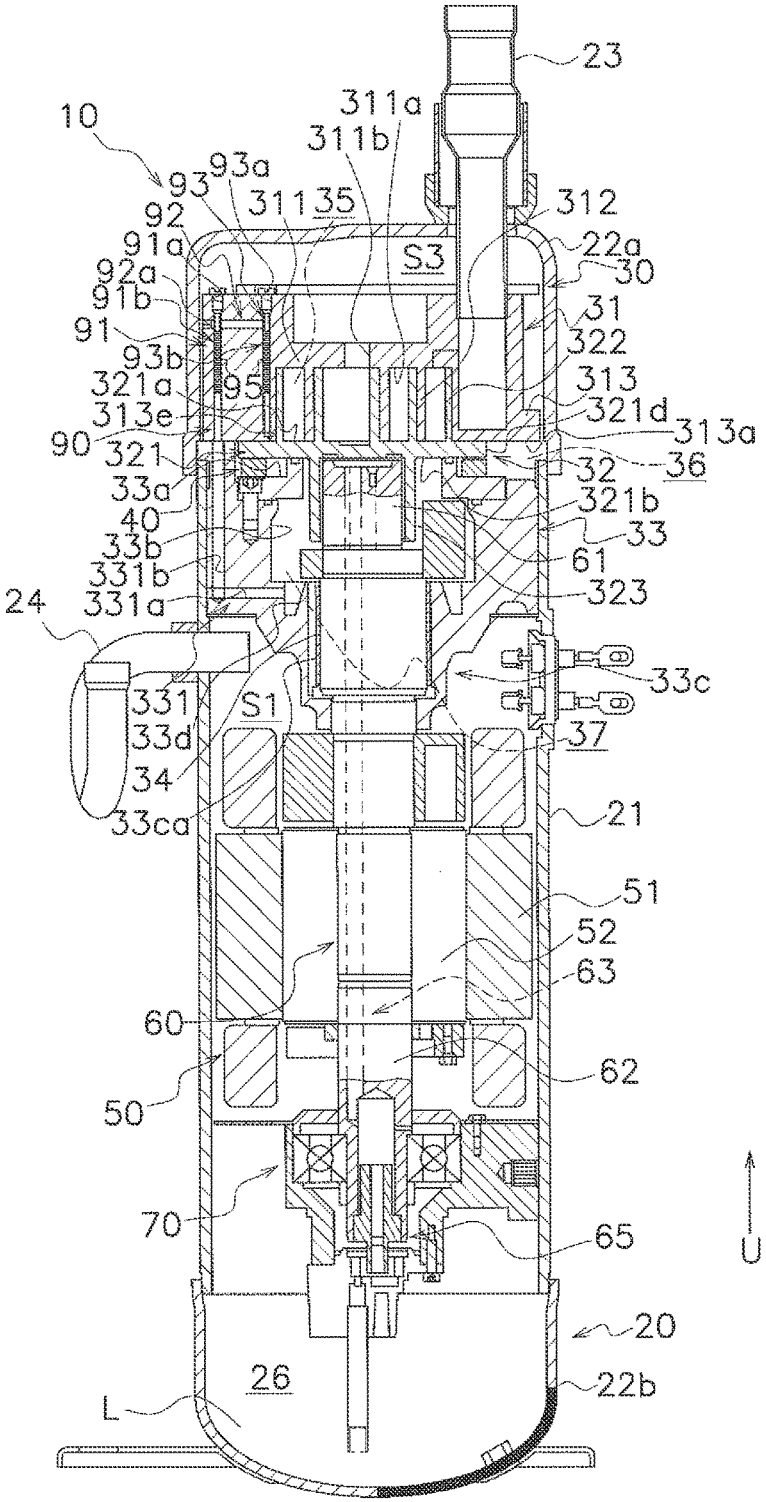
FIG. 1 is a schematic vertical sectional view of a scroll compressor according to an embodiment of the present invention.

The scroll compressor 10, as shown in FIG. 1, primarily comprises a casing 20, a scroll compression mechanism 30, an Oldham coupling 40, a drive motor 50, a crankshaft 60, and a lower bearing 70.

The configuration of the scroll compressor 10 is described below. In the following description, the arrow U in FIG. 1 is assumed as being oriented upwards unless otherwise specified.

(2) Detailed Configuration (2-1) Casing

The scroll compressor 10 has a vertical cylindrical casing 20. The casing 20 has a substantially cylindrical cylinder member 21 which opens at the top and bottom, as well as an upper lid 22*a* and a lower lid 22*b* which are provided respectively on the upper and lower ends of the cylinder member 21. The upper lid 22*a* and the lower lid 22*b* are securely welded to the cylinder member 21 so as to maintain airtightness.

The casing 20 accommodates the components of the scroll compressor 10, including the scroll compression mechanism 30, the Oldham coupling 40, the drive motor 50, the crankshaft 60, and the lower bearing 70. An oil-retention space 26 is formed in a lower part of the casing 20. An oil L for lubricating the scroll compression mechanism 30, etc. is retained in the oil-retention space 26. The oil-retention space 26 communicates with a first space S1 described below.

An intake tube 23 into which a gaseous refrigerant to be compressed by the scroll compression mechanism 30 is drawn is provided in an upper part of the casing 20, passing through the upper lid 22*a*. The lower end of the intake tube 23 is connected to the fixed scroll 31 of the scroll compression mechanism 30, which is described below. The intake tube 23 communicates with the compression chamber 35 of the scroll compression mechanism 30 described below. Gaseous refrigerant that is at low pressure prior to compression flows into the intake tube 23.

A discharge tube 24 through which gaseous refrigerant that is to be discharged from the casing 20 passes is provided in an intermediate part of the cylinder member 21 of the casing 20. More specifically, the discharge tube 24 is disposed so that an end thereof inside the casing 20 protrudes into the first space S1, which is formed below the housing 33 of the scroll compression mechanism 30, described below. High-pressure gaseous refrigerant compressed by the scroll compression mechanism 30 flows into the discharge tube 24.

(2-2) Scroll Compression Mechanism

As shown in FIG. 1, the scroll compression mechanism 30 primarily comprises a housing 33, a fixed scroll 31 disposed above the housing 33, and a movable scroll 32 that forms the compression chamber 35 in combination with the fixed scroll 31. An eccentric part space 37 and a back-pressure space 36 are formed between the movable scroll 32 and the housing 33.

(2-2-1) Fixed Scroll

Figure 2:
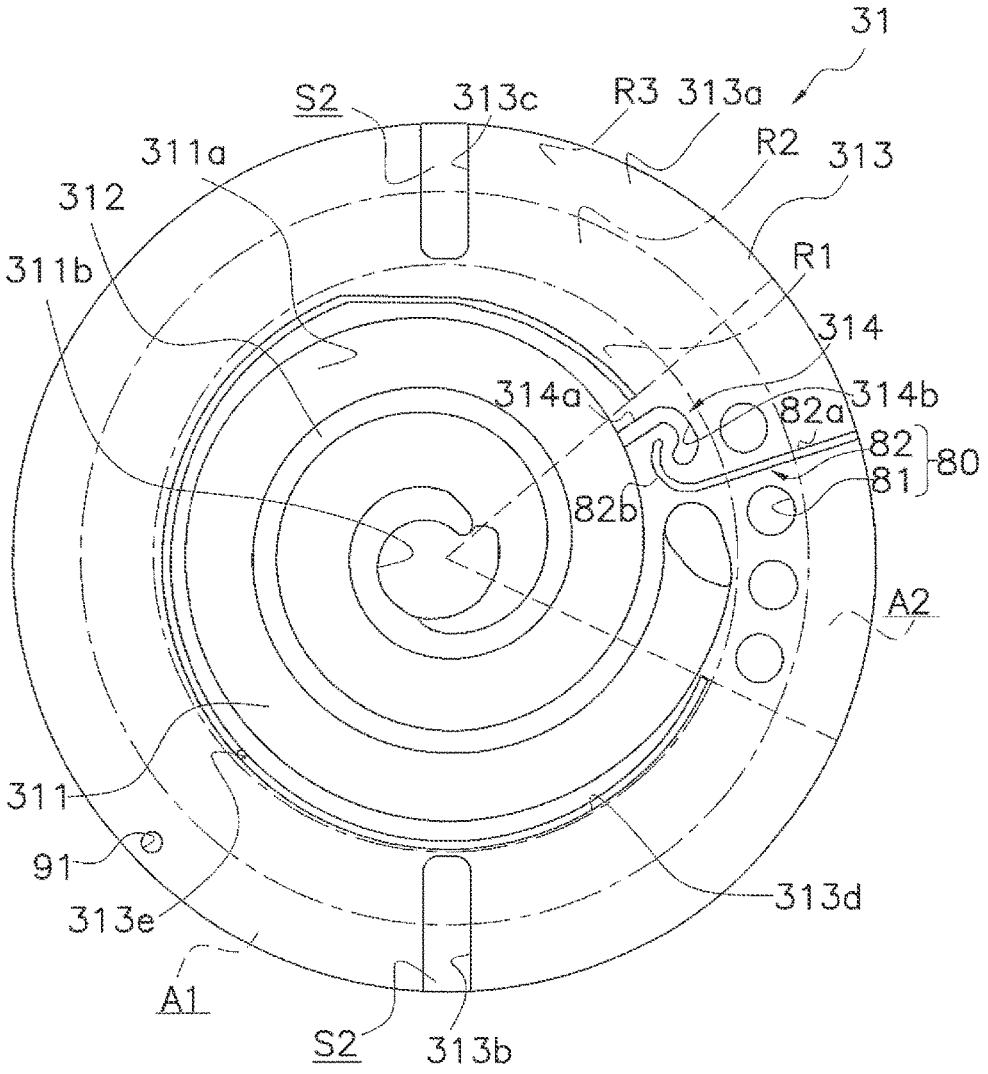
FIG. 2 is a schematic plan view of the fixed scroll of the scroll compressor of FIG. 1 as seen from below; the J-shaped second oil channel and the plurality of circular second oil channels being formed.

As shown in FIGS. 1 and 2, the fixed scroll 31 has a disk-shaped fixed-side end plate 311, a spiraling fixed-side lap 312 that protrudes from the front face (lower face 311*a*) of the fixed-side end plate 311, and a peripheral portion 313 that surrounds the fixed-side lap 312.

A non-circular discharge opening 311*b* that communicates with the compression chamber 35, described below, is formed substantially in the center of the fixed-side end plate 311 passing therethrough in the thickness direction. The gaseous refrigerant that has been compressed in the compression chamber 35 is discharged upwards from the discharge opening 311*b* and flows into the first space S1 through the refrigerant passage (not shown) formed in the fixed scroll 31 and the housing 33.

The fixed lap 312 is formed in a spiral shape and protrudes from the lower face 311*a* of the fixed-side end plate 311. The fixed-side lap 312 and a movable-side lap 322 of the movable scroll 32 described below are combined so that the lower face 311*a* of the fixed-side end plate 311 and the upper face 321*a* of the movable-side end plate 321 face each other, and the compression chamber 35 is formed between the fixed-side lap 312 and the movable-side lap 322 adjacent to each other. The movable scroll 32 is pressed against the fixed scroll 31 by a force produced in the back-pressure space 36 and the eccentric part space 37, as described below. An end face of the fixed-side lap 312 towards the movable scroll 32 and the upper face 321*a* of the movable-side end plate 321 are in tight contact. Similarly, an end face of the movable-side lap 322 towards the fixed scroll 31 and the lower face 311*a* of the fixed-side end plate 311 are in tight contact.

The peripheral portion 313 is formed as a thick-walled ring and is disposed so as to encompass the fixed-side lap 312.

A second oil introduction path 90 that communicates with a first oil introduction path 331 formed in the housing 33 described below is formed in the peripheral portion 313. An oil L that is supplied from the first oil introduction path 331 flows in the second oil introduction path 90. The oil L that has flowed through the second oil introduction path 90 is supplied to a first oil channel 313*d* described below.

The second oil introduction path 90 includes a first vertical passage 91, a first horizontal passage 92, and a second vertical passage 93.

The first vertical passage 91 is formed so as to pass through the peripheral portion 313 in the vertical direction (substantially vertical direction). A lower end of the first vertical passage 91 communicates with an upper opening of a vertical passage 331*b* of the first oil introduction path 331 described below. A first insertion hole 91*a* is formed at an upper end of the first vertical passage 91. A female thread is formed in the vicinity of the opening of the first insertion hole 91*a*. A flow-restricting member 95 is inserted into and secured in the first insertion hole 91*a*. A spiraling passage 91*b* is formed on the circumference of the first vertical passage 91 by the flow-restricting member 95. The spiraling passage 91*b* functions as a throttling part that adjusts the pressure of the oil L that is supplied to the first oil channel 313*d*.

Figure 3:
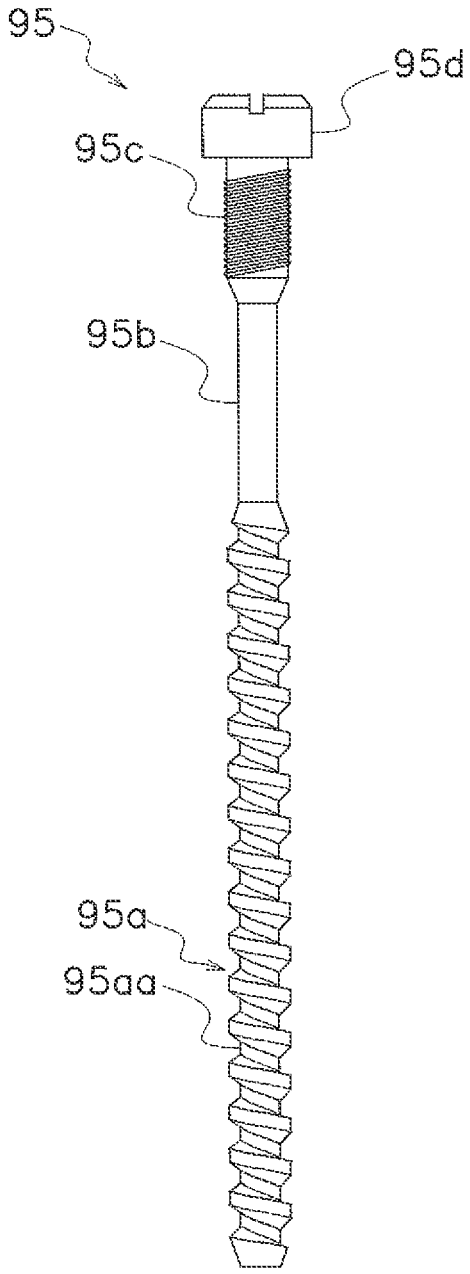
FIG. 3 is a schematic side view of the flow-restricting member provided in the fixed scroll of the scroll compressor of FIG. 1.

The flow-restricting member 95 is a substantially rod-shaped member, as shown in FIG. 3. The flow-restricting member 95 has a main body 95*a* disposed at one end, a small-diameter part 95*b* that is connected consecutively to the main body 95*a*, a threaded part 95*c* that is connected consecutively to the small-diameter part 95*b* on the side thereof opposite from the main body 95*a*, and a large-diameter part 95*d* that is connected consecutively to the threaded part 95*c* on the side thereof opposite the small-diameter part 95*b*. A continuous helical spiral channel 95*aa* is formed on an outer peripheral face of the main body 95*a*, and forms the spiraling passage 91*b* in the first vertical passage 91. A male thread that is screwed into the female thread formed in the vicinity of an opening of the first insertion hole 91*a* is formed in the threaded part 95*c*. The large-diameter part 95*d* is formed with a larger diameter than the first insertion hole 91*a* and constitutes an end part of the flow-restricting member 95 on the side opposite the main body 95*a*.

The flow-restricting member 95 is inserted from the main body 95*a* side into the first insertion hole 91*a*, and the male thread of the threaded part 95*c* and the female thread formed in the vicinity of the opening of the first insertion hole 91*a* are screwed together to secure the flow-restricting member 95 and the peripheral portion 313.

The second vertical passage 93 is formed so as to pass through the peripheral portion 313. A communication hole 313*e* that communicates with the first oil channel 313*d* is formed on a bottom end of the second vertical passage 93. The diameter of the communication hole 313*e* is formed smaller than the diameter of the second vertical passage 93 so as to be substantially the same as the width of the channel of the first oil channel 313*d*. A second insertion hole 93*a* is formed in a top end of the second vertical passage 93. A female thread is formed in the vicinity of an opening of the second insertion hole 93*a*. The flow-restricting member 95 is inserted into and secured in the second insertion hole 93*a*. A spiraling passage 93*b* is formed on the circumference on the second vertical passage 93 by the flow-restricting member 95. The spiraling passage 93*b* functions as a throttling part that adjusts the pressure of the oil L that is supplied to the first oil channel 313*d*.

Descriptions regarding, inter alia, securing of the second insertion hole 93*a* and the flow-restricting member 95 are omitted since they are similar to those related to securing the first insertion hole 91*a* and the flow-restricting member 95.

The first horizontal passage 92 is formed so as to communicate with the first vertical passage 91 and the second vertical passage 93 in the upper part of the peripheral portion 313. More specifically, the first horizontal passage 92 communicates with a portion of the first vertical passage 91 where the small-diameter part 95*b* of the flow-restricting member 95 is disposed and a portion of the second vertical passage 93 where the small-diameter part 95*b* of the flow-restricting member 95 is disposed. The first horizontal passage 92 extends substantially in the horizontal direction from an outer circumferential face of the peripheral portion 313 so as to communicate with the first vertical passage 91 and to reach to the second vertical passage 93. An opening of the outer circumferential face of the peripheral portion 313 of the first horizontal passage 92 is closed off by a plug 92*a*.

By proving a plurality of (two) flow-restricting members 95 in the second oil introduction path 90 to ensure the distance of the spiraling passages 91*b*, 93*b*, it is possible to reduce the oil L at high pressure (substantially discharge pressure) to a suitable pressure, while avoiding the flow path surface area of the spiraling passages 91*b*, 93*b* to become too small. This makes it possible to prevent that the second oil introduction path 90 is closed off because of clogging of the spiraling passage 93*b* with a small foreign matter or the like.

A lower face 313*a* of the peripheral portion 313 faces a front face (upper face 321*a*) of the movable-side end plate 321 of the movable scroll 32, which is described below. The movable scroll 32 is pressed against the fixed scroll 31 by a force that is produced in the back-pressure space 36 and the eccentric part space 37 described below. As a result, the portions where contact is made between the lower face 313*a* of the peripheral portion 313 and the upper face 321*a* of the movable-side end plate 321 are tightly attached.

The lower face 313*a* of the peripheral portion 313 has a regular sliding face R1 that always contacts with the upper face 321*a* of the movable-side end plate 321 when the movable scroll 32 revolves with respect to the fixed scroll 31 as described below, an intermittent sliding face R2 that makes intermittent contact with the upper face 321*a* of the movable-side end plate 321 when the movable scroll 32 revolves with respect to the fixed scroll 31, and a non-sliding face R3 that does not make contact with the upper face 321*a* of the movable-side end plate 321. As indicated by long dashed short dashed lines in FIG. 2, the regular sliding face R1, the intermittent sliding face R2, the non-sliding face R3 are arranged in the order from the center of the fixed scroll 31 towards the outer circumference, as seen in plan view. The intermittent sliding face R2 faces the back-pressure space 36 (described below) when it does not contact with the upper face 321*a* of the movable-side end plate 321. The non-sliding face R3 always faces the back-pressure space 36.

A first fixed-scroll key channel 313*b*, a second fixed-scroll key channel 313*c*, a first oil channel 313*d*, a second oil channel 80, and a communication channel 314 are formed on the lower face 313*a* of the peripheral portion 313. The channels are described below.

(2-2-1-1) Fixed-Scroll Key Channel

As shown in FIG. 2, the first and second fixed-scroll key channels 313*b*, 313*c* are substantially rectangular channels with rounded corners, with a lengthwise direction along the radial direction of the fixed scroll 31. The first and second fixed-scroll key channels 313*b*, 313*c* are formed over the intermittent sliding face R2 and the non-sliding face R3 from the vicinity of the boundary between the regular sliding face R1 and the intermittent sliding face R2 to the outer periphery of the peripheral portion 313. As shown in FIG. 2, the first and second fixed-scroll key channels 313*b*, 313*c* are disposed in point symmetry about the center of the fixed-side end plate 311 of the fixed scroll 31 as seen in plan view. The first and second fixed-scroll key channels 313*b*, 313*c* are formed so as not to pass through the peripheral portion 313 in the vertical direction.

Second key parts 43 of the Oldham coupling 40 (described below) fit into the first and second fixed-scroll key channels 313*b*, 313*c* and slide in the lengthwise direction of the first and second fixed-scroll key channels 313*b*, 313*c*; i.e., the radial direction of the fixed scroll 31. In other words, second key part sliding spaces S2 in which the second key parts 43 slide are respectively formed in the first and second fixed-scroll key channels 313*b*, 313*c*. The second key part sliding spaces S2 are in consistent communication with the back-pressure space 36 described below.

The distance (width) of the first and second fixed-scroll key channels 313*b*, 313*c* in a short direction is configured to be substantially equivalent to the width of the second key parts 43 in the circumferential direction. More specifically, the distance of the first and second fixed-scroll key channels 313*b*, 313*c* in the short direction is set so that the gap left when the second key parts 43 are fitted into the first and second fixed-scroll key channels 313*b*, 313*c* is as small as possible, within a range where the second key parts 43 can smoothly slide in the first and second fixed-scroll key channels 313*b*, 313*c*. The distances between upper faces of the second key parts 43 and an upper face of the first and second fixed-scroll key channels 313*b*, 313*c* are set so as to be longer than the gap between the second key parts 43 and the first and second fixed-scroll key channels 313*b*, 313*c* in the short direction.

(2-2-1-2) First Oil Channel

The first oil channel 313*d*, as shown in FIG. 2, is formed in a substantially are shape on the regular sliding face R1 along the boundary between the regular sliding face R1 and the intermittent sliding face R2. The first oil channel 313*d* is formed so as to be closer to the inner peripheral side of the peripheral portion 313; that is, closer to the fixed-side lap 312, in the vicinity of the second fixed-scroll key channel 313*c*. A cross-section of the first oil channel 313*d* is substantially rectangular, but no limitation is provided thereby; the first oil channel 313*d* may also be in a substantially triangular, arcuate, or other configuration.

As shown in FIG. 2, the first oil channel 313*d* is formed from the vicinity of the communication channel 314 described below to the vicinity of an winding end of the fixed-side lap 312 in the counter-clockwise direction when viewing the fixed scroll 31 from below. The first oil channel 313*d* does not communicate with the communication channel 314. As indicated by the dotted line in FIG. 2, an angle region with respect to the center of the fixed-side end plate 311 in which the first oil channel 313*d* is formed as seen in plan view is taken to be a first angle region A1, and the other angle region outside the first angle region A1 is taken to be a second angle region A2.

Oil L for lubricating the portion where contact is made between the peripheral portion 313 and the movable-side end plate 321 is supplied to the first oil channel 313*d*. The oil L in the high-pressure eccentric part space 37 described below is supplied to the first oil channel 313*d* from the communication hole 313*e* via the first oil introduction path 331 described below and the second oil introduction path 90. Oil L that is adjusted to a somewhat lower pressure than the high pressure (discharge pressure) by reducing the pressure with the flow-restricting member 95 provided on the second oil introduction path 90 is supplied to the first oil channel 313*d*.

(2-2-1-3) Second Oil Channel

The second oil channel 80 is formed in the second angle region A2 with respect to the center of the fixed-side end plate 311. The second oil channel 80 includes circular second oil channels 81 and a J-shaped second oil channel 82.

The circular second oil channels 81 are circular oil channels. Here, the channel is not restricted to being a narrow and long recess, but is defined so as to include recesses having other shapes. Multiple circular second oil channels 81 are formed at suitable locations for spreading the oil L to all over the portions where the sliding conditions between the lower face 313*a* of the peripheral portion 313 and the upper face 321*a* of the sliding movable scroll 32 are particularly extreme. Specifically, as shown in FIG. 2, a plurality of circular second oil channels 81 are formed in the second angle region A2 at substantially equal interval in the circumferential direction with respect to the center of the fixed-side end plate 311. The circular second oil channels 81 are formed on the intermittent sliding face R2 and communicate with the back-pressure space 36 described below for at least a prescribed period in a revolution cycle of the movable scroll 32 with respect to the fixed scroll 31 described below.

As shown in FIG. 2, the J-shaped second oil channel 82 is a substantially J-shaped channel that has an extending portion 82*a* that extends from the outer periphery of the peripheral portion 313 towards the center of the fixed-side end plate 311, and a curved portion 82*b* that extends from an end part of the extending portion 32*a* on the inner periphery side of the peripheral portion 313 and is formed so as to curve outwardly with respect to the center of the fixed-side end plate 311. The extending portion 82*a* extends between the circular second oil channel 81, which is disposed nearest to the communication channel 314, and the circular second oil channel 81 adjacent thereto. The curved portion 82*b* of the J-shaped second oil channel 82 is disposed so as to face a curved portion 314*b* of the communication channel 314 described below. In other words, a side of the curved portion 82*b* of the J-shaped second oil channel 82 which has a larger curvature is disposed so as to face a side of the curved portion 314*b* of the communication channel 314 which has a larger curvature. The J-shaped second oil channel 82 is formed across the regular sliding face R1, the intermittent sliding face R2, and the non-sliding face R3 and always communicates with the back-pressure space 36 described below.

(2-2-1-4) Communication Channel

The communication channel 314 is formed on the regular sliding face R1 in the second angle region A2 so that, when the movable scroll 32 revolves with respect to the fixed scroll 31 as described below, the communication channel 314 intermittently communicates with the back-pressure space 36 (described below) via the communication hole 321*c* formed in the movable-side end plate 321 of the movable scroll 32. The communication channel 314 is formed so as to extend from an inner peripheral part of the peripheral portion 313 in the radial direction of the fixed scroll 31 to near the boundary between the regular sliding face R1 and the intermittent sliding face R2. The communication channel 314, as shown in FIG. 2, is formed inward by substantially one complete turn from the winding end of the fixed-side lap 312. The communication channel 314 communicates with the compression chamber 35 at intermediate pressure located on the periphery side. The term "intermediate pressure" denotes a pressure between the intake pressure and the discharge pressure.

As shown in FIG. 2, the communication channel 314 is a J-shaped channel that has an extending portion 314*a* that extends from an inner edge of the peripheral portion 313 to jut towards the radially outward side of the fixed scroll 31, and a curved portion 314*b* that extends from an end part of the extending portion 314*a* on the outer periphery side of the peripheral portion 313 and is formed so as to curve inwardly with respect to the center of the fixed-side end plate 311.

As described below, when the movable scroll 32 revolves with respect to the fixed scroll 31, the compression chamber 35 at intermediate pressure that is located on the periphery side and the back-pressure space 36 are intermittently communicated with each other via the communication channel 314 and the communication hole 321*c*. In other words, the compression chamber 35 located on the periphery side and the back-pressure space 36 communicate with each other for at least a prescribed period in a single revolution cycle of the movable scroll 32.

(2-2-2) Movable Scroll

Figure 4:
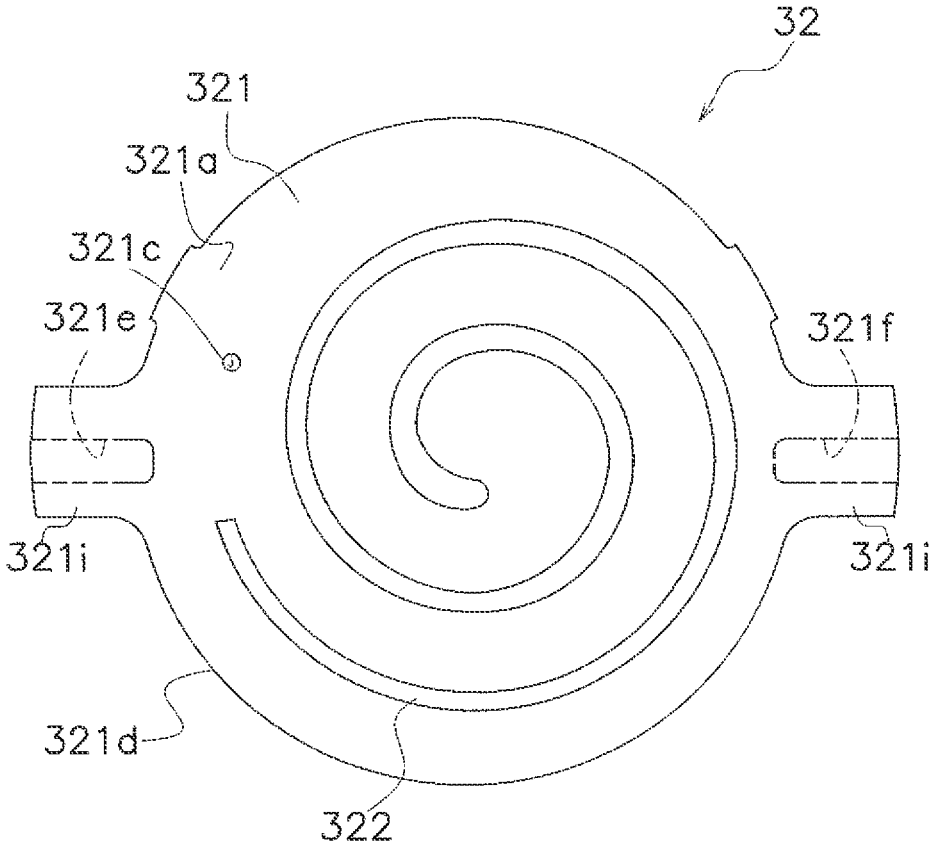
FIG. 4 is a schematic plan view of the movable scroll of the scroll compressor of FIG. 1 as seen from above.

As shown in FIGS. 1 and 4, the movable scroll 32 has a substantially disk-shaped movable-side end plate 321, a spiraling movable-side lap 322 that protrudes from a front face (upper face 321*a*) of the movable-side end plate 321, and a cylindrically formed boss portion 323 that protrudes from a back face (lower face 321*b*) of the movable-side end plate 321.

As shown in FIG. 4, two protrusions 321*i* that protrude in a radially outward direction of the movable-side end plate 321, as seen in plan view, are provided at the periphery of the movable-side end plate 321. A first and second movable-scroll key channel 321*e*, 321*f* that open downwards are formed on the respective protrusions 321*i*.

As shown in FIG. 4, the first and second movable-scroll key channels 321*e*, 321*f* are formed in the protrusions 321*i* that are disposed so as to face each other across the center of the movable-side end plate 321. The first and second movable-scroll key channels 321*e*, 312*f* are substantially rectangular channels with rounded corners, with a lengthwise direction along the radial direction of the movable scroll 32. The first and second movable-scroll key channels 321*e*, 321*f* are formed on the lower face 321*b* of the movable-side end plate 321 up to the vicinity of the vertical-direction (thickness-direction) center of the movable-side end plate 321. The first and second movable-scroll key channels 321*e*, 321*f* are disposed in a direction rotated 90° in plan view relative to the first and second fixed-scroll key channels 313*b*, 313*c* formed on the fixed-side end plate 311. First key parts 42 of the Oldham coupling 40 described below fit into the first and second movable-scroll key channels 321*e*, 321*f* and slide in the lengthwise direction of the first and second movable-scroll key channels 321*e*, 321*f*; i.e., the radial direction of the movable scroll 32. The distance (width) of the first and second movable-scroll key channels 321*e*, 321*f* in a short direction is configured to be substantially equivalent to the width of the first key parts 42 in the circumferential direction. More specifically, the distance of the first and second movable-scroll key channels 321*e*, 321*f* in the short direction is set so that the gap left when the first key parts 42 are fitted into the first and second movable-scroll key channels 321*e*, 321*f* is as small as possible within a range where the first key parts 42 can smoothly slide in the first and second movable-scroll key channels 321*e*, 321*f*. The distances between an upper faces of the first key part 42 and an upper face of the first and second movable-scroll key channels 321*e*, 321*f* are set to be longer than the distance of the gap between the first key parts 42 and the first and second fixed-scroll key channels 313*b*, 313*c* in the short direction.

In addition, the communication hole 321*c* which intermittently communicates the communication channel 314 formed in the peripheral portion 313 of the fixed scroll 31 and the back-pressure space 36 (described below) is formed on the movable-side end plate 321 of the movable scroll 32 so as to pass through the movable-side end plate 321 in the thickness direction. The communication hole 321*c* is disposed so as to communicate with the communication channel 314 in a prescribed period in the single revolution cycle when the movable scroll 32 revolves with respect to the fixed scroll 31. Communication between the communication hole 321*c* and the communication channel 314 is described below.

The boss portion 323 is a cylindrical portion with a closed upper end. The boss portion 323 and an eccentric part 61 of the crankshaft 60 described below are connected as a consequence of the eccentric part 61 being inserted into the boss portion 323. The boss portion 323 is disposed inside an eccentric part space 37 that is formed between the movable scroll 32 and the housing 33 described below.

As described below, an oil L at high pressure is supplied to the eccentric part space 37 from the oil-retention space 26 that communicates with the first space S1 at high pressure. As a result, the pressure of the eccentric part space 37 becomes high. More specifically, in steady states, the pressure of the eccentric part space 37 substantially reaches the discharge pressure of the scroll compressor 10. Due to the pressure that acts in the eccentric part space 37, a force that presses the movable scroll 32 upwards towards the fixed scroll 31 is generated on the lower face 321*b* of the movable-side end plate 321 in the eccentric part space 37. The movable scroll 32 is thus in close contact with the fixed scroll 31 due to the combination of the force arising due to the pressure in the eccentric part space 37 and a force arising due to a pressure in the back-pressure space 36 described below.

The movable scroll 32 engages with the fixed scroll 31 via the Oldham coupling 40 described below. The Oldham coupling 40 is a member that allows the movable scroll 32 to revolve without rotating by itself. When the crankshaft 60 that is connected to the boss portion 323 by the eccentric part 61 rotates, the first key parts 42 of the Oldham coupling 40 slide inside the first and second movable-scroll key channels 321*e*, 321*f*, and the second key parts 43 slide inside the first and second fixed-scroll key channels 313*b*, 313*c*. The movable scroll 32 is revolved with respect to the fixed scroll 31 without rotating by itself, and gaseous refrigerant inside the compression chamber 35 is compressed. More specifically, the compression chamber 35 undergoes a decrease in volume while moving towards the center of the fixed-side end plate 311 and the movable-side end plate 321 due to the revolution of the movable scroll 32, and the pressure in the compression chamber 35 increases along therewith. In other words, the pressure of the compression chamber 35 is higher on the center side than on the periphery side.

(2-2-3) Back-Pressure Space

The back-pressure space 36 is formed above the housing 33 (described below) and is formed on the back face side (the lower face 321*b* side) of the movable-side end plate 321 of the movable scroll 32. The back-pressure space 36 faces a peripheral face 321*d* and the lower face 321*b* of the movable-side end plate 321. The back-pressure space 36 is disposed on the periphery side with respect to the eccentric part space 37 that is formed in the vicinity of the center of the movable-side end plate 321. A seal ring (not shown) is disposed between the housing 33 and the lower face 321*b* of the movable-side end plate 321 in order that the back-pressure space 36 and the eccentric part space 37 are partitioned in an air-tight state.

The back-pressure space 36 communicates with the compression chamber 35 at intermediate pressure located on the periphery side via the communication hole 321*c* and the communication channel 314 when the movable scroll 32 revolves relative to the fixed scroll 31. In other words, the back-pressure space 36 communicates with the compression chamber 35 located on the periphery side for at least a prescribed period in the single revolution cycle of the movable scroll 32.

Due to the pressure that acts in the back-pressure space 36, a force that presses the movable scroll 32 upwards towards the fixed scroll 31 is generated on the lower face 321*b* of the movable-side end plate 321. The movable scroll 32 is in close contact with the fixed scroll 31 as a result of the combination of the force generated by pressure in the eccentric part space 37 and the force generated by the pressure in the back-pressure space 36.

The back-pressure space 36 always communicates with the J-shaped second oil channel 82 formed in the peripheral portion 313 of the fixed scroll 31, and communicates with the circular second oil channel 81 for a prescribed period in the single revolution cycle of the movable scroll 32. In addition, the back-pressure space 36 communicates with the second key part sliding spaces S2 in which the second key parts 43 of the Oldham coupling 40 slide. The back-pressure space 36 also communicates with an upper space S3 that is formed above the fixed scroll 31.

(2-2-4) Housing

The housing 33 is press-fitted into the cylinder member 21 and is secured along the entire body in the circumferential direction at the outer circumferential face thereof. In addition, the housing 33 and the fixed scroll 31 are disposed so that an upper end face of the housing 33 faces the lower face 313*a* of the peripheral portion 313 of the fixed scroll 31 and are secured, for example, with bolt (not shown).

A second recess 33*b* that is disposed at the center part of the upper face so as to recede, a bearing housing part 33*c* that is disposed below the second recess 33*b*, and a first recess 33*a* that is disposed so as to surround the second recess 33*b* are formed in the housing 33. In addition, an oil-retention part 33*d* in which oil L that flows into the eccentric part space 37 is retained and a first oil introduction path 331 that communicates with the oil-retention part 33*d* are formed in the housing 33.

The second recess 33*b* surrounds the side face of the eccentric part space 37 in which the boss portion 323 of the movable scroll 32 is disposed.

A bearing metal 34 is provided in the bearing housing part 33*c*. The bearing metal 34 rotatably supports a main shaft 62 of the crankshaft 60. A bearing housing part oil passage 33*ca* is formed at the periphery of the bearing metal 34. The oil L supplied to the bearing metal 34 for lubrication from an oil feeding pathway 63 formed in the main shaft 62 (described below) flows in the bearing housing part oil passage 33*ca* towards the eccentric part space 37.

The first recess 33*a* is a part on the bottom face and side face that surround the back-pressure space 36.

The oil-retention part 33*d* is a recess that is formed as an annular shape below the second recess 33*b*. An oil L that flows into the eccentric part space 37 from the oil feeding pathway 63 described below is retained in the oil-retention part 33*d*.

The oil L flows into the eccentric part space 37 primarily via a pathway described below. The oil L flows out from an upper end opening of the oil feeding pathway 63 formed in the main shaft 62 described below, and, after lubricating the sliding parts where sliding occurs between the eccentric part 61 of the crankshaft 60 and the boss portion 323 of the movable scroll 32, flows into the eccentric part space 37. In addition, the oil L flows out from an opening (not shown) of the oil feeding pathway 63, the opening being formed at a location facing the inner surface of the bearing metal 34, and, after lubricating the sliding parts of the main shaft 62 of the crankshaft 60 and the bearing metal 34, the oil L flows into the eccentric part space 37 through the bearing housing part oil passage 33*ca* and from an upper end of the bearing metal 34.

The high-pressure (substantially-discharge-pressure) oil L in the oil-retention part 33*d* is supplied by the pressure differential to the first oil channel 313*d* that is formed around the compression chamber 35 at low or intermediate pressure via the first oil introduction path 331 and the second oil introduction path 90.

The first oil introduction path 331 includes a horizontal passage 331*a* that extends from the oil-retention part 33*d* and a vertical passage 331*b* that communicates with the horizontal passage 331*a* and the second oil introduction path 90.

The horizontal passage 331*a* extends substantially horizontally from an outer circumferential face of the housing 33 to the oil-retention part 33*d*. An opening on the outer circumferential face of the housing 33 of the horizontal passage 331*a* is closed by the cylinder member 21.

The vertical passage 331*b* extends substantially vertically so as to communicate the horizontal passage 331*a* and the second oil introduction path 90 with each other. An upper end opening of the vertical passage 331*b* communicates with the first vertical passage 91 of the second oil introduction path 90.

(2-3) Oldham Coupling

Figure 5:
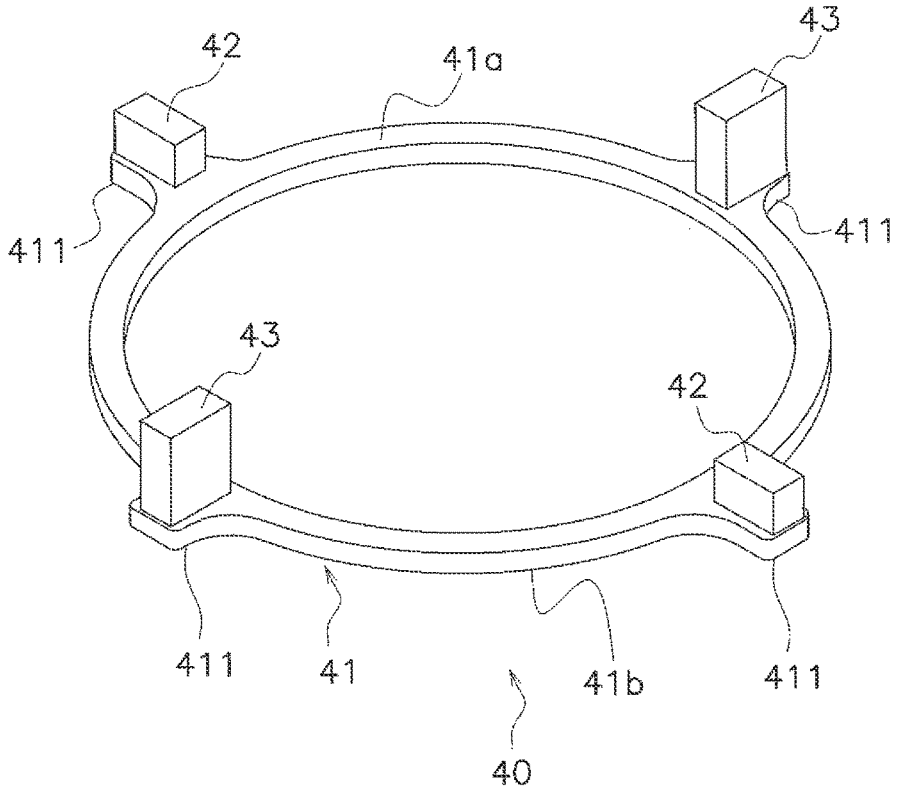
FIG. 5 is a schematic perspective view of an Oldham coupling of the scroll compressor of FIG. 1.

The Oldham coupling 40 is a member for preventing the movable scroll 32 from rotating. As shown in FIG. 5, the Oldham coupling primarily has a ring part 41, first key parts 42, and second key parts 43.

The ring part 41, as shown in FIG. 5, is a substantially ring-shaped member, and has protrusions 411 that protrude radially outward at four locations. An upper face 41*a* (front face) and lower face 41*b* (back face) of the ring part 41 are substantially flat surfaces that are parallel to each other. The upper face 41*a* of the ring part 41 faces the lower face 321*b* of the movable-side end plate 321 and the lower face 41*b* of the ring part 41 faces the bottom face of the first recess 33*a* of the housing 33.

The first key parts 42 are a pair of protrusions that extend upwards from the protrusions 411 of the ring part 41 to the first and second movable-scroll key channels 321*e*, 321*f* of the movable scroll 32. In other words, the first key parts 42 are protrusions that extend upwards from the upper face 41*a* (front face) of the ring part 41. The pair of first key parts 42 are disposed point symmetrically about the center of the ring part 41. The first key parts 42 are fitted into the first and second movable-scroll key channels 321*e*, 321*f* of the movable scroll 32 and slide in the first and second movable-scroll key channels 321*e*, 321*f*.

The second key parts 43 are a pair of protrusions that extend upwards from the protrusions 411 of the ring part 41 to the first and second fixed-scroll key channels 313*b*, 313*c* of the fixed scroll 31. In other words, the second key parts 43 are protrusions that extend upwards from the upper face 41*a* (front face) of the ring part 41. The pair of second key parts 43 are disposed point symmetrically with respect to the center of the ring part 41. In plan view, the second key parts 43 are disposed at locations that are rotated at 900 relative to the first key parts 42 with respect to the center of the ring part 41. The second key parts 43 are fitted into the first and second fixed-scroll key channels 313*b*, 313*c* of the fixed scroll 31 and slide inside the first and second fixed-scroll key channels 313*b*, 313*c*.

(2-4) Drive Motor

A drive motor 50 is an example of the drive part. The drive motor 50 has an annular stator 51 that is fixed to an inner wall face of the cylinder member 21 and a rotor 52 that is rotatably accommodated in the stator 51 interposed by a slight gap (air gap passage).

The rotor 52 is linked with the movable scroll 32 via the crankshaft 60 that is disposed so as to extend vertically along the axial center of the cylinder member 21. As a result of the rotation of the rotor 52, the movable scroll 32 revolves cyclically with respect to the fixed scroll 31, and the gaseous refrigerant inside the compression chamber 35 is compressed.

(2-5) Crankshaft

The crankshaft 60 transmits drive power form the drive motor 50 to the movable scroll 32. The crankshaft 60 is disposed so as to extend vertically along the axial center of the cylinder member 21 and is connected with the rotor 52 of the drive motor 50 and the movable scroll 32 of the scroll compression mechanism 30.

The crankshaft 60 has a main shaft 62, the central axis of which aligns with the axial center of the cylinder member 21, and the eccentric part 61, which is eccentric with respect to the axial center of the cylinder member 21.

The eccentric part 61 is connected to the boss portion 323 of the movable scroll 32 as described above.

The main shaft 62 is rotatably supported by the bearing metal 34 in the bearing housing part 33*c* of the housing 33 and a lower bearing 70 described below. In addition, the main shaft 62 is connected to the rotor 52 of the drive motor 50 between the bearing housing part 33*c* and the lower bearing 70.

As shown in FIG. 1, the oil feeding pathway 63 for supplying oil L for lubricating the scroll compression mechanism 30, etc. is formed inside the crankshaft 60.

The oil feeding pathway 63 extends substantially vertically through the interior of the crankshaft 60 from a lower end to an upper end of the crankshaft 60. The oil feeding pathway 63 opens on the upper and lower ends of the crankshaft 60. In addition, an opening (not shown) is formed in the oil feeding pathway 63 so as to face an inner surface of the bearing metal 34 disposed in the bearing housing part 33*c*.

A positive displacement oil feed pump 65 is provided at the lower end opening of the oil feeding pathway 63. The oil feed pump 65 suctions the oil L in the oil-retention space 26 and supplies the oil L to the oil feeding pathway 63.

The oil L flowing through the oil feeding pathway 63 and then flowing out from the upper end opening of the oil feeding pathway 63 flows into the eccentric part space 37 after lubricating the sliding parts of the eccentric part 61 of the crankshaft 60 and the boss portion 323 of the movable scroll 32.

The oil L flowing through the oil feeding pathway 63 and then flowing out from the opening formed so as to face an inner surface of the bearing metal 34 disposed on the bearing housing part 33*c* flows into the eccentric part space 37 through the bearing housing part oil passage 33*ca* or from the upper end of the bearing metal 34 after lubricating the sliding parts of the main shaft 62 and the bearing metal 34.

(2-6) Lower Bearing

The lower bearing 70 is disposed below the drive motor 50. The lower bearing 70 is secured to the cylinder member 21. The lower bearing 70 constitutes a bearing on a lower-end side of the crankshaft 60 and rotatably supports the main shaft 62 of the crankshaft 60.

(3) Operation of the Scroll Compressor

The operation of the scroll compressor 10 is described.

(3-1) Compression Operation

When the drive motor 50 is driven, the rotor 52 rotates, and the crankshaft 60 that is connected to the rotor 52 also rotates. When the crankshaft 60 rotates, the movable scroll 32 revolves with respect to the fixed scroll 31 without rotating by itself due to the function of the Oldham coupling 40. Next, low-pressure (intake-pressure) gaseous refrigerant is suctioned into the casing 20 via the intake tube 23. More specifically, the low-pressure gaseous refrigerant is suctioned to the compression chamber 35 via the intake tube 23 from the periphery side of the compression chamber 35. As the movable scroll 32 revolves, communication between the intake tube 23 and the compression chamber 35 is interrupted, the volume of the compression chamber 35 decreases, and the pressure in the compression chamber 35 accordingly increases. The gaseous refrigerant undergoes an increase in pressure as it moves from the compression chamber 35 on the periphery side to the compression chamber 35 on the central side, and finally the pressure of the refrigerant becomes high pressure (discharge pressure). The pressure of the gaseous refrigerant of the compression chamber 35 on the periphery side is a value between the intake pressure and the discharge pressure (intermediate pressure). The high-pressure gaseous refrigerant compressed by the scroll compression mechanism 30 is discharged from the discharge opening 311*b* that is located in the vicinity of the center of the fixed-side end plate 311. Subsequently, the high-pressure gaseous refrigerant passes through the refrigerant passage (not shown) formed in the fixed scroll 31 and the housing 33, and flows into the first space S1. After the scroll compressor 10 is started up, the pressure of the first space S1 increases progressively to substantially reach the discharge pressure in steady-state operation. The gaseous refrigerant of the first space S1 is discharged from the discharge tube 24.

The pressure in the eccentric part space 37 and the back-pressure space 36 during operation of the scroll compressor 10 will now be described.

First, the pressure in the eccentric part space 37 will be described. Because the oil L is supplied from the oil-retention space 26 to the eccentric part space 37, the pressure in the eccentric part space 37 substantially equals the pressure in the oil-retention space 26. Since the oil-retention space 26 communicates with the first space S1, the pressure of the oil-retention space 26 reaches the pressure substantially equal to the pressure in the first space S1. In other words, high-pressure (substantially-discharge-pressure) oil L is normally retained in the oil-retention space 26. For this reason, the eccentric part space 37 into which the oil L is supplied from the oil-retention space 26 also is typically at high pressure (substantially discharge pressure).

Figure 6:
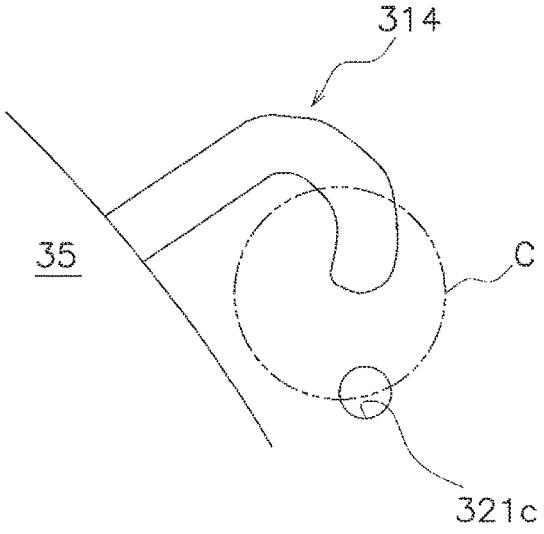
FIG. 6 is a diagram depicting the movement whereby communication occurs between the communication channel formed in a peripheral portion of the fixed scroll and a communication hole formed in the movable-side end plate of the movable scroll in the scroll compressor of FIG. 1.

The pressure in the back-pressure space 36 will now be described. When the movable scroll 32 revolves, the communication hole 321*c* of the movable-side end plate 321 moves along path C, which is represented by the chain double-dotted line in FIG. 6 with respect to the communication channel 314 of the peripheral portion 313, as seen in plan view. As a result, the communication hole 321*c* of the movable-side end plate 321 and the communication channel 314 of the peripheral portion 313 communicate with each other for a prescribed period in the revolving cycle of the movable scroll 32, and the compression chamber 35 at intermediate pressure located on the periphery side and the back-pressure space 36 are communicated with each other. As a result, the pressure in the back-pressure space 36 becomes intermediate pressure. As described above, as the compression chamber 35 and the back-pressure space 36 intermittently communicate with each other via the communication hole 321*c* and the communication channel 314, controlling the pressure in the back-pressure space 36 at the desired pressure is straightforward.

(3-2) Oil Feeding Operation

When the crankshaft 60 rotates, the oil L in the oil-retention space 26 flows upwards through the oil feeding pathway 63 to the opening at the top end of the crankshaft 60 and flows out from the opening. In addition, a part of the oil L flowing in the oil feeding pathway 63 flows out from an opening (not shown) that is formed so as to face the inner surface of the bearing metal 34 provided in the bearing housing part 33*c*. The oil L that flows out from the upper end opening of the oil feeding pathway 63 lubricates the sliding parts of the eccentric part 61 and the boss portion 323, and then flows into the eccentric part space 37. The oil L that flows out from the opening that is formed so as to face the inner surface of the bearing metal 34 lubricates the sliding parts of the main shaft 62 and the bearing metal 34, and then flows into the eccentric part space 37. Some of the oil L is retained in the oil-retention part 33*d*.

The oil L retained in the oil-retention part 33*d* is supplied by the pressure differential to the first oil channel 313*d* formed in the peripheral portion 313 of the fixed scroll 31 via the first oil introduction path 331 and the second oil introduction path 90. The pressure of the oil L that is supplied to the first oil channel 313*d* is reduced by the flow-restricting member 95 provided in the second oil introduction path 90, and is therefore somewhat lower than high pressure (discharge pressure). The pressure of the oil L that is supplied to the first oil channel 313*d* is referred to as semi-high pressure.

The oil L that is supplied to the first oil channel 313*d* that is formed in the first angle region A1 spreads in the vicinity of the first oil channel 313*d* on the upper face 321*a* of the movable-side end plate 321 and the lower face 313*a* of the peripheral portion 313 due to the revolution of the movable scroll 32. In addition, because the semi-high-pressure oil L is supplied to the first oil channel 313*d* in steady-state operation, the oil L, due to the pressure differential, moves on the upper face 321*a* of the movable-side end plate 321 and the lower face 313*a* of the peripheral portion 313 in a substantially radial direction on the fixed scroll 31 towards the compression chamber 35 at low or intermediate pressure that is located on the inner circumference side of the first oil channel 313*d*. In addition, the oil L, due to the pressure differential, moves on the upper face 321*a* of the movable-side end plate 321 and the lower face 313*a* of the peripheral portion 313 in a substantially radial direction on the fixed scroll 31 towards the back-pressure space 36 at intermediate pressure that is located on the outer circumference side of the movable scroll 32; i.e., towards the outer circumferential side of the first oil channel 313*d*. In other words, the oil L that is supplied to the first oil channel 313*d* is primarily supplied to the regular sliding face R1 and intermittent sliding face R2 of the first angle region A1 and the upper face 321*a* of the movable-side end plate 321 that is in contact with the regular sliding face R1 and intermittent sliding face R2 of the first angle region A1.

In addition, a part of the oil L in the eccentric part space 37 leaks out to the back-pressure space 36 via the gap in the seal ring (not shown) that is provided between the lower face 321*b* of the movable-side end plate 321 and the housing 33. Since the circular second oil channel 81 is formed in the intermittent sliding face R2 and a part of the J-shaped second oil channel 82 is formed on the non-sliding face R3 and the intermittent sliding face R2, the circular second oil channel 81 and the J-shaped second oil channel 82 communicate with the back-pressure space 36 for a prescribed period in the revolution cycle of the movable scroll 32 (The J-shaped second oil channel 82 always communicate with the back-pressure space 36). Therefore, the oil L is collected in the circular second oil channel 81 and the J-shaped second oil channel 82 at the back-pressure space 36. Then, as the movable scroll 32 revolves, the oil L that is collected in the circular second oil channel 81 and the J-shaped second oil channel 82 is supplied to the vicinity of the circular second oil channel 81 and J-shaped second oil channel 82; i.e., the regular sliding face R1 and intermittent sliding face R2 of the second angle region A2 and the upper face 321*a* of the movable-side end plate 321 that is in contact with the regular sliding face R1 and intermittent sliding face R2 of the second angle region A2.

In particular, the oil L that is collected in the J-shaped second oil channel 82 is supplied to the vicinity of the curved portion 314*b* of the communication channel 314.

A flow of gaseous refrigerant is produced in the vicinity of the curved portion 314*b* of the communication channel 314 when the communication hole 321*c* of the movable-side end plate 321 and the communication channel 314 of the peripheral portion 313 intermittently communicate with each other; therefore, the oil L is not readily retained. However, because the curved portion 314*b* of the communication channel 314 and the curved portion 82*b* of the J-shaped second oil channel 82 are disposed so as to face each other, the oil L is readily supplied in adequate quantities to the vicinity of the curved portion 314*b* of the communication channel 314.

(4) Features (4-1)

The scroll compressor 10 according to the present embodiment is provided with the fixed scroll 31, the movable scroll 32, and the drive motor 50. The fixed scroll 31 has the tabular fixed-side end plate 311, the spiraling fixed-side lap 312 that protrudes from the lower face 311*a* (front face) of the fixed-side end plate 311, and the peripheral portion 313 as the thrust sliding portion which surrounds the fixed-side lap 312. The movable scroll 32 has the tabular movable-side end plate 321, and the spiraling movable-side lap 322 that protrudes from the upper face 321*a* (front face) of the movable-side end plate 321. The drive motor 50 is linked to the movable scroll 32 via a crankshaft 60, and revolves the movable scroll 32. The fixed-side lap 312 and the movable-side lap 322 are brought together so that the lower face 311*a* of the fixed-side end plate 311 and the upper face 321*a* of the movable-side end plate 321 face each other, and the compression chamber 35 is formed between the fixed-side lap 312 and movable-side lap 322 adjacent to each other. The drive motor 50 revolves the movable scroll 32 cyclically so that a gaseous refrigerant in the compression chamber 35 is compressed. The back-pressure space 36 that communicates with the compression chamber 35 on the peripheral side for at least a prescribed period in the revolution cycle of the movable scroll 32 is formed at the lower face 321*b* (back face) side of the movable-side end plate 321 of the movable scroll 32. The communication hole 321*c* that communicates with the back-pressure space 36 is formed in the movable-side end plate 321. The first oil channel 313*d* and the communication channel 314 are formed on the regular sliding face R1 that is in consistent contact with the upper face 321*a* of the movable-side end plate 321 in the single revolution cycle of the movable scroll 32, in the peripheral portion 313 that faces the upper face 321*a* of the movable-side end plate 321. Also, in the peripheral portion 313, the circular second oil channel 81 is formed on the intermittent sliding face R2 that is in intermittent contact with the upper face 321*a* of the movable-side end plate 321 for a prescribed period in the single revolution cycle of the movable scroll 32, and the J-shaped second oil channel 82 is formed across the regular sliding face R1 and the intermittent sliding face R2. The first oil channel 313*d* extends in an arc shape in the first angle region A1 with respect to the center of the fixed-side end plate 311 as seen in plan view. Oil L is supplied to the first oil channel 313*d* from the oil-retention space 26 at high pressure and retained in the first oil channel 313*d*. The communication channel 314 is disposed in the second angle region A2, which is external to the first angle region A1, with respect to the center of the fixed-side end plate 311 as seen in plan view. The communication channel 314 communicates with the compression chamber 35, as well as with the communication hole 321*c* of the movable scroll 32 for a prescribed period. The circular second oil channel 81 and the J-shaped second oil channel 82 are disposed in the second angle region A2 with respect to the center of the fixed-side end plate 311 as seen in plan view and communicates with the back-pressure space 36 for at least a prescribed period.

In the present embodiment, the second oil channel 80 (the circular second oil channel 81 and the J-shaped second oil channel 82) that communicates with the back-pressure space 36 for a prescribed period is formed in the vicinity of the communication channel 314 of the peripheral portion 313 of the fixed scroll 31 where it is difficult to form the first oil channel 313*d* (in the second angle region A2 with respect to the center of the fixed-side end plate 311 of the fixed scroll 31, as seen in plan view).

In the first angle region A1, the oil L being supplied to the first oil channel 313*d* is supplied to a portion where contact is made between the peripheral portion 313 and the movable-side end plate 321 of the movable scroll 32. Since the first oil channel 313*d* is not formed in the second angle region A2, the oil L being supplied to the peripheral portion 313 via the first oil channel 313*d* is not readily supplied to the second angle region A2. However, since the second oil channel 80 (the circular second oil channel 81 and the J-shaped second oil channel 82) that communicates with the back-pressure space 36 is formed in the second angle region A2, the oil L being present in the back-pressure space 36 is collected in the circular second oil channel 81 and the J-shaped second oil channel 82 and is supplied to the portion where contact is made between the peripheral portion 313 and the movable-side end plate 321 in the second angle region A2.

In other words, the oil L can be supplied to the entire portion where contact is made between the peripheral portion 313 of the fixed scroll 31 and the movable-side end plate 321 of the movable scroll 32 by the first oil channel 313*d*, the circular second oil channel 81 and the J-shaped second oil channel 82. As a result, the reliability of the scroll compressor 10 can be enhanced.

(4-2)

The scroll compressor 10 according to the present embodiment is provided with the fixed scroll 31, the movable scroll 32, and the drive motor 50. The fixed scroll 31 has the tabular fixed-side end plate 311, the spiraling fixed-side lap 312 that protrudes from the lower face 311*a* (front face) of the fixed-side end plate 311, and the peripheral portion 313 as the thrust sliding portion which surrounds the fixed-side lap 312. The movable scroll 32 has the tabular movable-side end plate 321, and the spiraling movable-side lap 322 that protrudes from the upper face 321*a* (front face) of the movable-side end plate 321. The drive motor 50 is linked to the movable scroll 32 via the crankshaft 60, and revolves the movable scroll 32. The fixed-side lap 312 and the movable-side lap 322 are brought together so that the lower face 311*a* of the fixed-side end plate 311 and the upper face 321*a* of the movable-side end plate 321 face each other, and the compression chamber 35 is formed between the fixed-side lap 312 and movable-side lap 322 adjacent to each other. The drive motor 50 revolves the movable scroll 32 cyclically so that a gaseous refrigerant in the compression chamber 35 is compressed. The back-pressure space 36 that communicates with the compression chamber 35 on the peripheral side for at least a prescribed period in the revolution cycle of the movable scroll 32 is formed at the lower face 321*b* (back face) side of the movable-side end plate 321 of the movable scroll 32. The communication hole 321*c* that communicates with the back-pressure space 36 is formed in the movable-side end plate 321. The second oil introduction path 90, in which an oil L supplied from the oil-retention space 26 at high pressure flows, is formed in the fixed scroll 31. The first oil channel 313*d* and the communication channel 314 are formed on the regular sliding face R1 that is in consistent contact with the upper face 321*a* of the movable-side end plate 321 in the single revolution cycle of the movable scroll 32, in the peripheral portion 313 that faces the upper face 321*a* of the movable-side end plate 321. Also, in the peripheral portion 313, the circular second oil channel 81 is formed on the intermittent sliding face R2 that is in intermittent contact with the upper face 321*a* of the movable-side end plate 321 for a prescribed period in the single revolution cycle of the movable scroll 32, and the J-shaped second oil channel 82 is formed across the regular sliding face R1 and the intermittent sliding face R2. The first oil channel 313*d* extends in an arc shape in a first angle region A1 with respect to the center of the fixed-side end plate 311 as seen in plan view. Oil L is supplied to the first oil channel 313*d* from the second oil introduction path 90 and retained in the first oil channel 313*d*. The communication channel 314 is disposed in the second angle region A2, which is external to the first angle region A1, with respect to the center of the fixed-side end plate 311 as seen in plan view. The communication channel 314 communicates with the compression chamber 35, as well as with the communication hole 321*c* of the movable scroll 32 for a prescribed period. The circular second oil channel 81 and the J-shaped second oil channel 82 are disposed in the second angle region A2 with respect to the center of the fixed-side end plate 311 as seen in plan view, and communicates with the back-pressure space 36 for at least a prescribed period.

It is thereby the oil L can be supplied to the entire portion where contact is made between the thrust sliding portion and the second end plate by the first oil channel and second oil channel. As a result, the reliability of the scroll compressor can be enhanced.

(4-3)

According to the scroll compressor 10 of the present embodiment, the communication channel 314 extends radially with respect to the center of the fixed-side end plate 311 as seen in plan view and is formed into a J-shape that curves inwardly with respect to the center of the fixed-side end plate 311. A J-shaped second oil channel 82 extends radially towards the center of the fixed-side end plate 311 as seen in plan view and is formed into a J-shape that curves outwardly with respect to the center of the fixed-side end plate 311. The curved portion 314*b* of the communication channel 314 and the curved portion 82*b* of the J-shaped second oil channel 82 are disposed facing each other.

Since the J-shaped second oil channel 82 is formed corresponding to the J-shaped communication channel 314 in such a manner that the curved portion 314*b* and the curved portion 82*b* facing each other, J-shaped second oil channel 82 can be disposed close to the communication channel 314. In addition, the J-shaped second oil channel 82 can be disposed so that the curved portion 82*b* of the J-shaped second oil channel 82 surrounds the curved portion 314*b* of the communication channel 314. For this reason, oil L can be sufficiently supplied through the J-shaped second oil channel 82 in the vicinity of the communication channel 314 where it is difficult to retain the oil L due to the effect of the flow of the refrigerant (the flow of refrigerant flowing from the compression chamber 35 into the back-pressure space 36 via the communication channel 314 and the communication hole 321*c*). As a result, the reliability of the scroll compressor 10 can be enhanced.

(4-4)

Furthermore, according to the scroll compressor 10 of the present embodiment, part of the J-shaped second oil channel 82 is formed on the regular sliding face R1 of the peripheral portion 313, the regular sliding face R1 being in consistent contact with the upper face 321*a* of the movable-side end plate 321.

An oil L is therefore supplied to the regular sliding face R1 of the peripheral portion 313, which always contacts with the movable-side end plate 321, via the J-shaped second oil channel 82. There is a particular need for the regular sliding face R1 to lubricate because the regular sliding face R1 always contacts with the movable-side end plate 321, and the reliability of the scroll compressor 10 can be enhanced by adequately supplying oil L to the regular sliding face R1.

(4-5)

According to the scroll compressor 10 of the present embodiment, the first oil channel 313*d* and the communication channel 314 are formed on the regular sliding face R1.

In the present embodiment, the compression chamber 35 on the peripheral side (at intermediate pressure) and the back-pressure space 36 are communicated only through the communication channel 314 and communication hole 321*c* as the communication channel 314 is formed on the regular sliding face R1, and therefore the pressure of the back-pressure space 36 is controlled to an appropriate pressure.

Meanwhile, oil cannot be supplied from the back-pressure space 36 to the portion where contact is made between the peripheral portion 313 and the movable-side end plate 321 through the communication channel 314. However, because part of the J-shaped second oil channel 82 that communicates with the back-pressure space 36 is formed on the regular sliding face R1 in the second angle region A2, it is possible to supply the oil L on the regular sliding face R1 in the second angle region A2 of the peripheral portion 313 while implementing control on the pressure of the back-pressure space 36.

In addition, because the first oil channel 313*d* is formed on the regular sliding face R1 in the first angle region A1, the oil L is readily provided on the regular sliding face R1 of the peripheral portion 313 that especially requires lubrication, and therefore a highly reliable scroll compressor 10 can be obtained.

(4-6)

According to the scroll compressor 10 of the present embodiment, the J-shaped second oil channel 82 always communicates with the back-pressure space 36.

In the present embodiment, because the J-shaped second oil channel 82 always communicates with the back-pressure space 36, an oil L tends to be reliably collected in the J-shaped second oil channel 82, and therefore the oil L is readily provided to the second angle region A2 from the J-shaped second oil channel 82. As a result, the reliability of the scroll compressor 10 can be enhanced.

(4-7)

According to the scroll compressor 10 of the present embodiment, the second oil channel 80 has the plurality of channels including the circular second oil channels 81 and the J-shaped second oil channel 82.

In the present embodiment, an oil L is readily and reliably retained in the second oil channel 80 because the plurality of second oil channels 80 are present. Also, it is possible to dispose circular second oil channels 81 and the J-shaped second oil channel 82 at a selected area where the oil L is not readily supplied. Therefore, the oil L is readily and reliably provided from the second oil channel 80 to the portion where contact is made between the peripheral portion 313 of the second angle region A2 and the movable-side end plate 321. As a result, the reliability of the scroll compressor 10 can be enhanced.

(5) Modifications

The above embodiment may be modified within a range that does not depart from the gist of the present invention.

Modifications of the present embodiment are indicated below. A plurality of modifications can also be combined as is appropriate.

(5-1) Modification A

Figure 7:
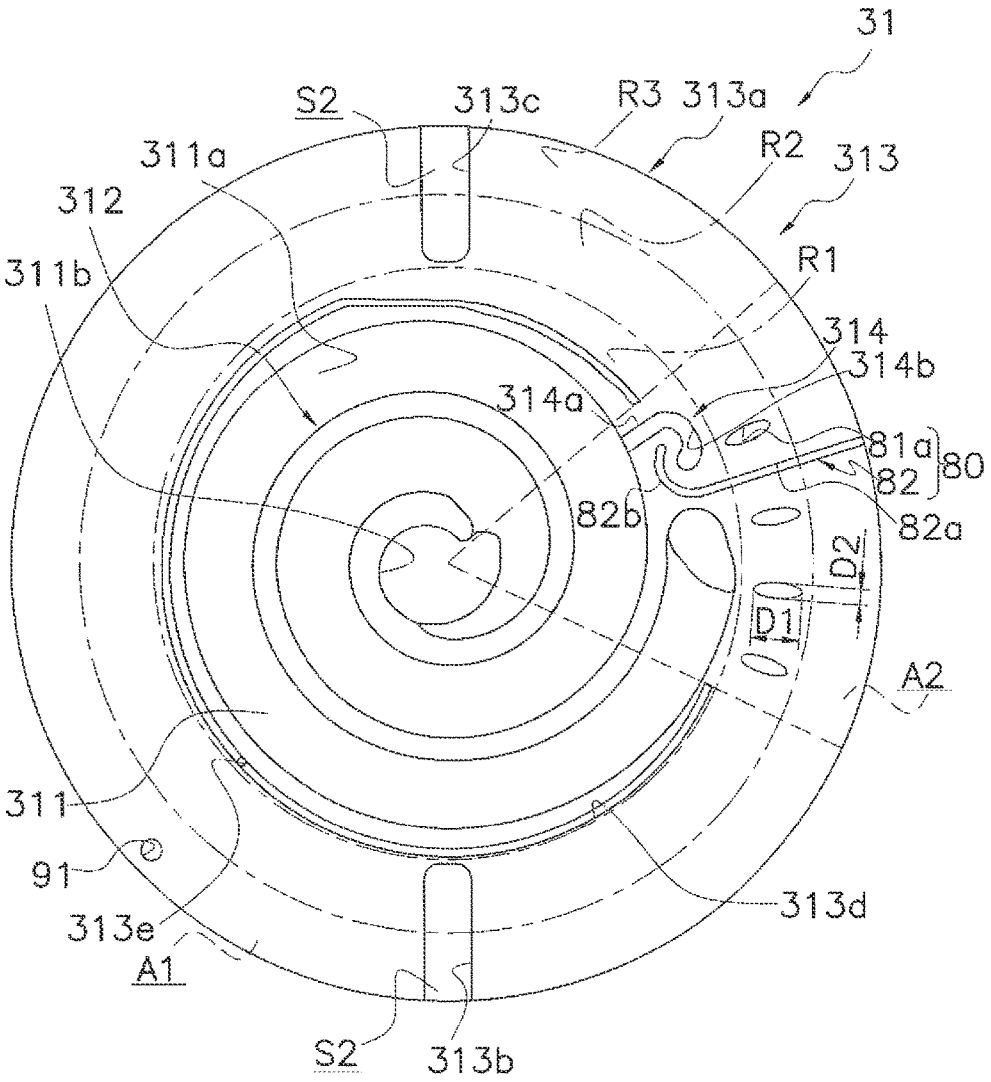
FIG. 7 is a plan view of the fixed scroll of the scroll compressor according to Modification A, as seen from below; an ellipsoidal second oil channel being formed instead of a circular second oil channel.
Figure 8:
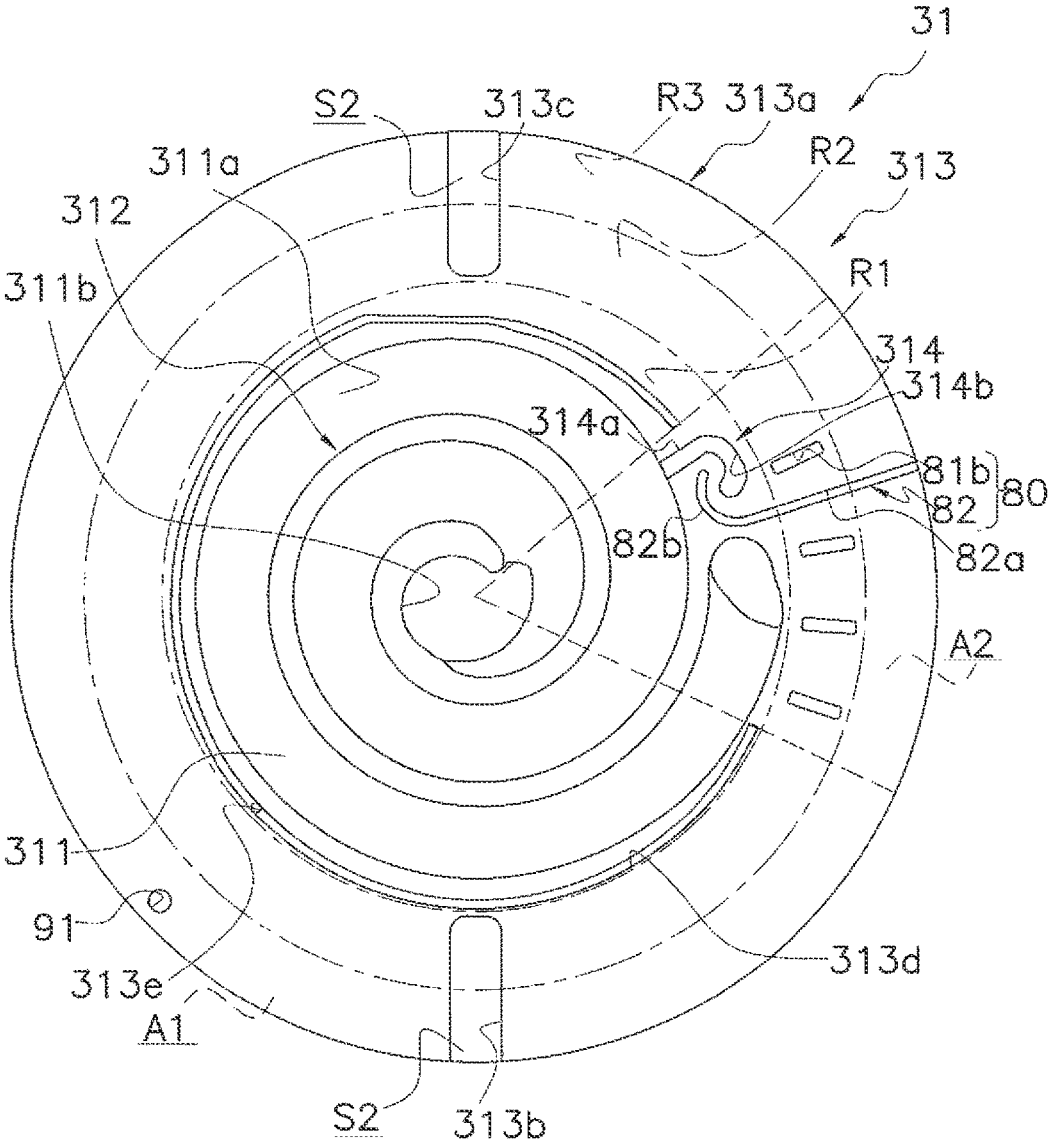
FIG. 8 is a plan view of the fixed scroll of the scroll compressor according to Modification A, as seen from below; a rectangular second oil channel being formed instead of a circular second oil channel.

According to the embodiment presented above, the second oil channel 80 includes circular second oil channels 81 and the J-shaped second oil channel 82. However, such an arrangement is not provided by way of limitation. As shown in FIG. 7 and FIG. 8, instead of the circular second oil channels 81, ellipsoidal second oil channels 81*a* or rectangular second oil channels 81*b* may also be formed. The rectangular shape of the present modification includes a rectangular shape with rounded corners, as shown in FIG. 8.

As seen in plan view, the second oil channels 80 (circular second oil channel 81, J-shaped second oil channel 82, ellipsoidal second oil channel 81*a*, and rectangular second oil channel 81*b*) extend radially a first distance D1 and circumferentially a second distance D2 with respect to the center of the fixed-side end plate 311, as shown in, e.g., FIG. 7. The first distance D is preferably equal to or greater than the second distance D2.

In the case that the second oil channel 80 (circular second oil channel 81, J-shaped second oil channel 82, ellipsoidal second oil channel 81*a*, and rectangular second oil channel 81*b*) extends further circumferentially than radially in the fixed scroll 31, as seen in plan view, it is possible that a peripheral portion of the movable-side end plate 321 (a corner where the upper face 321*a* of the movable-side end plate 321 and the peripheral face 321*d* intersect) is get caught by the second oil channel 80 while the movable scroll 32 is revolving. However, by having the second oil channel 80 extend further radially than circumferentially or extend equally radially and circumferentially (in other words, by setting the first distance D1≥the second distance D2), the movable scroll 32 is not readily get caught on the second oil channel 80 when the movable scroll 32 revolves. It is accordingly possible to supply an oil L to the second angle region A2 without adversely affecting the revolving motion of the movable scroll 32, and thereby to realize a highly reliable scroll compressor 10.

Moreover, by making the second oil channel 80 to be formed in a circular, ellipsoidal, rectangular, or J-shape, it is possible to readily form the second oil channel 80 for supplying the oil L to the second angle region A2, and enhance the reliability of the scroll compressor 10.

(5-2) Modification B

According to the embodiment presented above and modification A, the circular second oil channels 81, the ellipsoidal second oil channels 81*a*, and the rectangular second oil channels 81*b* are formed in the intermittent sliding face R2; however, such an arrangement is not provided by way of limitation.

Figure 9:
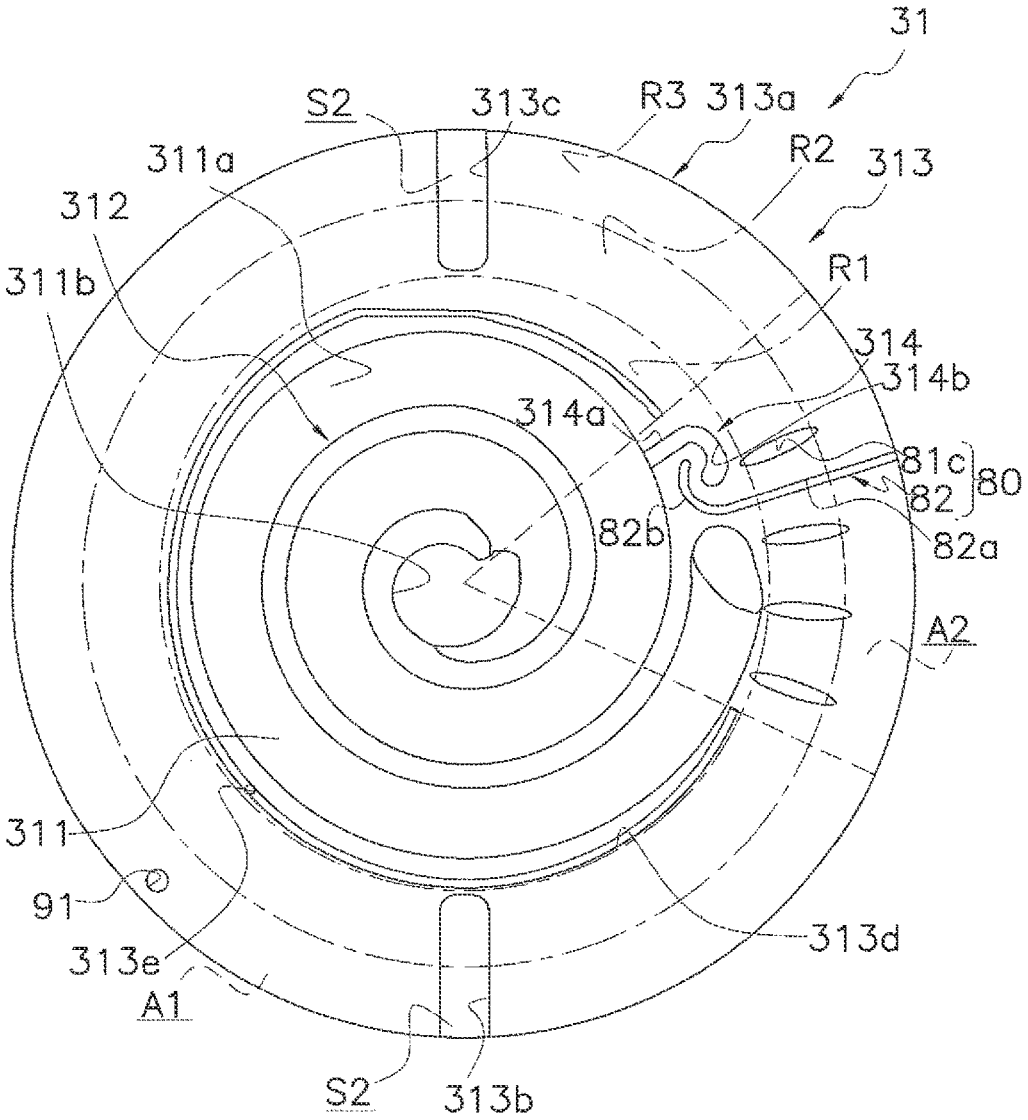
FIG. 9 is a plan view of the fixed scroll of the scroll compressor according to Modification B, as seen from below; the ellipsoidal second oil channel being formed over the regular sliding face, the intermittent sliding face, and the non-sliding face.
Figure 10:
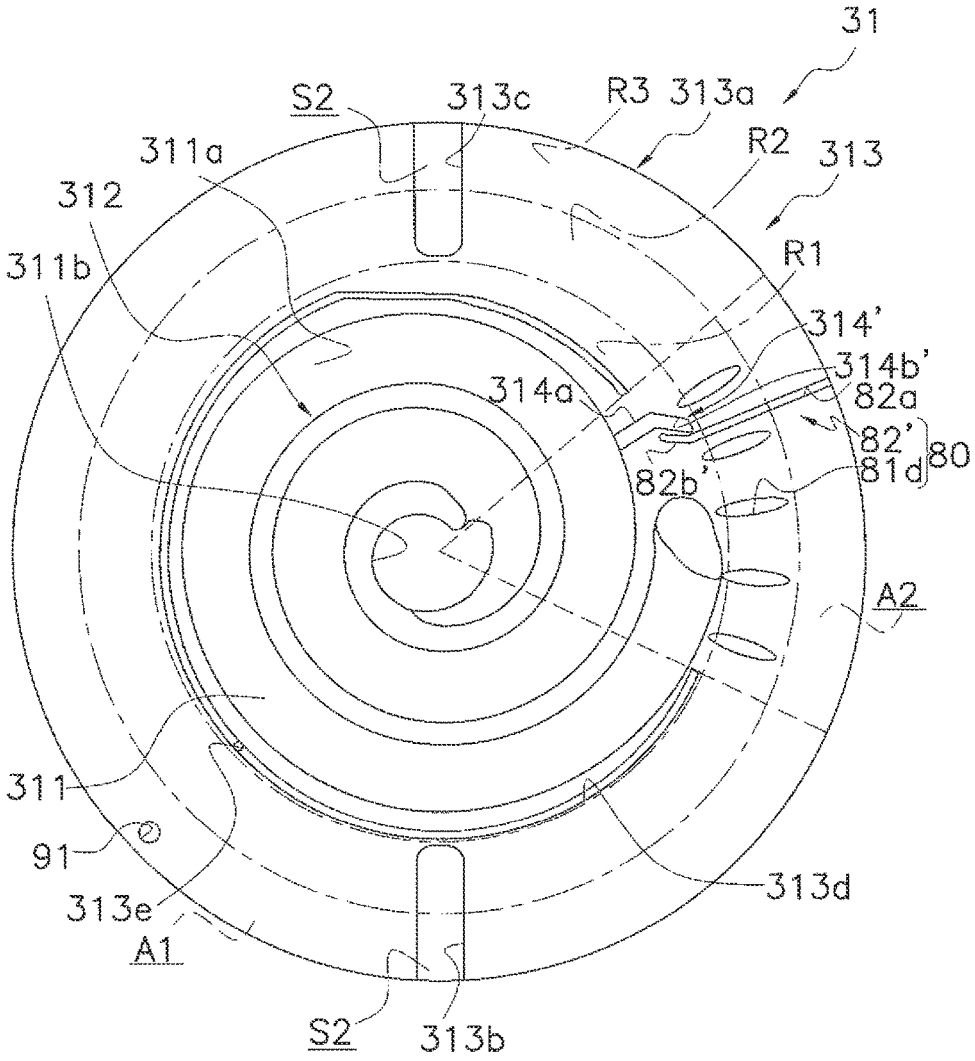
FIG. 10 is a plan view of the fixed scroll of the scroll compressor according to Modifications B and D, as seen from below; the ellipsoidal second oil channel being formed over the regular sliding face and the intermittent sliding face, and a substantially L-shaped communication channel and a L-shaped second oil channel in a substantially L shape being formed in a peripheral portion of the fixed scroll.

For example, when an ellipsoidal oil channel is to be formed, an ellipsoidal second oil channel 81*c* may also be formed across the regular sliding face R1, the intermittent sliding face R2, and the non-sliding face R3, as shown in FIG. 9. Also, an ellipsoidal second oil channel 81*d* may also be formed across the regular sliding face R1 and the intermittent sliding face R2, as shown in FIG. 10. The same applies when forming oil channels of other shapes.

When part of a channel is formed on the regular sliding face R1 like the ellipsoidal second oil channel 81*d* and the ellipsoidal second oil channel 81*c*, an oil L is adequately supplied to a surface that requires lubrication, and the reliability of the scroll compressor 10 is enhanced.

Furthermore, when part of a channel is formed on the non-sliding face R3 like the ellipsoidal second oil channel 81*c*, i.e., when the ellipsoidal second oil channel 81*c* is always communicated with the back-pressure space 36, the oil L is readily collected in the ellipsoidal second oil channel 81*c*. Therefore, the oil L is readily supplied from the ellipsoidal second oil channel 81*c* to the second angle region A2. As a result, the reliability of the scroll compressor 10 can be enhanced.

(5-3) Modification C

According to the embodiment presented above, the circular second oil channels 81 are disposed circumferentially in substantially the same interval to the fixed scroll 31; however, such an arrangement is not provided by way of limitation. Also, the quantity of the circular second oil channels 81 is not limited to the quantity which is indicated in FIG. 2.

Preferably, the arrangement and the number of the second oil channel 80 including the circular second oil channels 81 is decided so that an oil L is adequately supplied to the entire second angle region A2.

(5-4) Modification D

According to the embodiment presented above, the J-shaped communication channel 314 as well as J-shaped second oil channel 82 are formed on the lower face 313*a* of a peripheral portion 313; however, such an arrangement is not provided by way of limitation.

For example, as shown in FIG. 10, a communication channel 314' may also be formed substantially in an L-shape with an extending portion 314*a*, and a second extending portion 314*b*' that extends from the outer distal end of the extending portion 314*a* in a direction different to that in which the extending portion 314*a* extends. As a second oil channel corresponding thereto, as shown in FIG. 10, a substantially L-shaped second oil channel 82' may also be formed with an extending portion 82*a* and a second extending portion 82*b*' that extends substantially parallel to the second extending portion 314*b*' of the communication channel 314' from the inner distal end of the extending portion 82*a*.

Also, a communication channel and corresponding second oil channel may also be arranged in a linear fashion.

(5-5) Modification E

According to the embodiment presented above, the second key part sliding space S2 in which the second key part 43 of an Oldham coupling 40 slides is formed in a peripheral portion 313 of the fixed scroll 31. However, such an arrangement is not provided by way of limitation. A second key part sliding space in which a second key part slides may also be formed in the housing 33; e.g., as in Patent Literature 1.

INDUSTRIAL APPLICABILITY

The present invention can be applied to scroll compressors in which a back-pressure space is formed on a back face side and a lateral face side of a movable scroll, and a communication channel via which a compression chamber at intermediate pressure and the back-pressure space are communicated at a desired timing is formed in a fixed scroll.

What is claimed is:

1. A scroll compressor comprising:

a fixed scroll having a tabular first end plate, a first spiraling lap protruding from a front face of the first end plate, and a thrust sliding portion surrounding the first spiraling lap;

a movable scroll having a tabular second end plate and a second spiraling lap protruding from a front face of the second end plate; and a drive part linked to the movable scroll via a crankshaft, the drive part revolving the movable scroll, the first spiraling lap and the second spiraling lap being brought together so that the front face of the first end plate and the front face of the second end plate face each other, and a compression chamber is formed between the first spiraling lap and the second spiraling lap adjacent to each other, the drive part revolving the movable scroll cyclically so that a gaseous refrigerant in the compression chamber is compressed, a back-pressure space formed at a back face side of the second end plate of the movable scroll, the back pressure space communicating with the compression chamber on a peripheral side for at least a first prescribed period in a revolution cycle of the movable scroll, a communication hole formed in the second end plate, the communication hole communicating with the back-pressure space, and on a sliding face contacting the front face of the second end plate for at least a second prescribed period in the revolution cycle of the movable scroll, in the thrust sliding portion facing the front face of the second end plate, there being formed a first oil channel extending in an arc shape in a first angle region with respect to a center of the first end plate as seen in plan view, an oil being supplied to the first oil channel from a high-pressure space communicating with the compression chamber at high pressure and retained in the first oil channel, a communication channel disposed in a second angle region, which is external to the first angle region, with respect to the center of the first end plate as seen in plan view, the communication channel communicating with the compression chamber, and, for at least a third prescribed period in the revolution cycle of the movable scroll, communicating with the communication hole, and a second oil channel disposed in the second angle region with respect to the center of the first end plate as seen in plan view, the second oil channel communicating with the back-pressure space for at least a fourth prescribed period in the revolution cycle of the movable scroll.

2. The scroll compressor according to claim 1, wherein the second oil channel extends radially a first distance and circumferentially a second distance with respect to the center of the first end plate as seen in plan view, and the first distance is at least as large as the second distance.

3. The scroll compressor according to claim 2, wherein the second oil channel is one of circular, ellipsoidal, rectangular, J-shaped, and L-shaped as seen in plan view.

4. The scroll compressor according to claim 1, wherein the communication channel extends radially with respect to the center of the first end plate as seen in plan view and is formed into a J-shape that curves inwardly with respect to the center of the first end plate, and the second oil channel extends radially towards the center of the first end plate as seen in plan view and is formed into a J-shape which curves outwardly with respect to the center of the first end plate.

5. The scroll compressor according to claim 1, wherein at least part of the second oil channel is formed on a regular sliding face of the thrust sliding portion, the regular sliding face always contacting with the front face of the second end plate.

6. The scroll compressor according to claim 5, wherein the first oil channel and the communication channel are formed on the regular sliding face.

7. The scroll compressor according to claim 1, wherein the second oil channel always communicates with the back-pressure space.

8. The scroll compressor according to claim 1, wherein the second oil channel includes a plurality of channels.

9. The scroll compressor according to claim 1, wherein the second oil channel is at least partly formed in an intermittent sliding face of the thrust sliding portion, the intermittent sliding face intermittently contacting the front face of the second end plate when the movable scroll revolves with respect to the fixed scroll.

10. A scroll compressor comprising:

a fixed scroll having a tabular first end plate, a first spiraling lap protruding from a front face of the first end plate, and a thrust sliding portion surrounding the first spiraling lap;

a movable scroll having a tabular second end plate and a second spiraling lap protruding from a front face of the second end plate; and a drive part linked to the movable scroll via a crankshaft, the drive part revolving the movable scroll, the first spiraling lap and the second spiraling lap being brought together so that the front face of the first end plate and the front face of the second end plate face each other, and a compression chamber is formed between the first spiraling lap and the second spiraling lap adjacent to each other;

the drive part revolving the movable scroll cyclically so that a gaseous refrigerant in the compression chamber is compressed, a back-pressure space formed at a back face side of the second end plate of the movable scroll, the back pressure space communicating with the compression chamber on a peripheral side for at least a first prescribed period in a revolution cycle of the movable scroll, a communication hole formed in the second end plate, the communication hole communicating with the back-pressure space, an oil introduction path formed in the fixed scroll, an oil supplied from a high-pressure space communicating with the compression chamber at high pressure flowing in the oil introduction path, and on a sliding face contacting the front face of the second end plate for at least a second prescribed period in the revolution cycle of the movable scroll, in the thrust sliding portion facing the front face of the second end plate, there being formed a first oil channel extending in an arc shape in a first angle region with respect to a center of the first end plate as seen in plan view, the oil being supplied to the first oil channel from the oil introduction path and retained in the first oil channel, a communication channel disposed in a second angle region, that is external to the first angle region, with respect to the center of the first end plate as seen in plan view, the communication channel communicating with the compression chamber, and, for at least a third prescribed period in the revolution cycle of the movable scroll, communicating with the communication hole, and a second oil channel disposed in the second angle region with respect to the center of the first end plate as seen in plan view, the second oil channel communicating with the back-pressure space for at least a fourth prescribed period in the revolution cycle of the movable scroll.

11. The scroll compressor according to claim 10, wherein the second oil channel extends radially a first distance and circumferentially a second distance with respect to the center of the first end plate as seen in plan view, and the first distance is at least as large as the second distance.

12. The scroll compressor according to claim 11, wherein the second oil channel is one of circular, ellipsoidal, rectangular, J-shaped, and L-shaped as seen in plan view.

13. The scroll compressor according to claim 10, wherein the communication channel extends radially with respect to the center of the first end plate as seen in plan view and is formed into a J-shape that curves inwardly with respect to the center of the first end plate, and the second oil channel extends radially towards the center of the first end plate as seen in plan view and is formed into a J-shape which curves outwardly with respect to the center of the first end plate.

14. The scroll compressor according to claim 10, wherein at least part of the second oil channel is formed on a regular sliding face of the thrust sliding portion, the regular sliding face always contacting with the front face of the second end plate.

15. The scroll compressor according to claim 14, wherein the first oil channel and the communication channel are formed on the regular sliding face.

16. The scroll compressor according to claim 10, wherein the second oil channel always communicates with the back-pressure space.

17. The scroll compressor according to claim 10, wherein the second oil channel includes a plurality of channels.

18. The scroll compressor according to claim 10, wherein the second oil channel is at least partly formed in an intermittent sliding face of the thrust sliding portion, the intermittent sliding face intermittently contacting the front face of the second end plate when the movable scroll revolves with respect to the fixed scroll.

* * * * *